US006499152B2

(12) United States Patent
Johnson

(10) Patent No.: US 6,499,152 B2
(45) Date of Patent: Dec. 31, 2002

(54) FLUSH CONTROLLER

(75) Inventor: Dwight N. Johnson, Carlsbad, CA (US)

(73) Assignee: Geberit Technik AG, Jona (CH)

( * ) Notice: Subject to any disclaimer, the term of this patent is extended or adjusted under 35 U.S.C. 154(b) by 12 days.

(21) Appl. No.: 09/766,471

(22) Filed: Jan. 18, 2001

(65) Prior Publication Data

US 2002/0092090 A1 Jul. 18, 2002

(51) Int. Cl.[7] ..... E03D 13/00

(52) U.S. Cl. ..... 4/302; 4/304; 251/129.04; 137/110

(58) Field of Search ..... 4/302, 303, 304, 4/305, 313, 314, DIG. 3; 251/129.04, 129.03; 137/110, 601.14

(56) References Cited

U.S. PATENT DOCUMENTS

| | | | | |
|---|---|---|---|---|
| 4,309,781 A | | 1/1982 | Lissau | |
| 4,793,588 A | | 12/1988 | Laverty, Jr. | |
| 4,805,247 A | | 2/1989 | Laverty, Jr. | |
| 4,916,762 A | | 4/1990 | Shaw | |
| 4,989,277 A | | 2/1991 | Tsutsui et al. | |
| 5,187,818 A | | 2/1993 | Barrett, Sr. et al. | |
| 5,195,558 A | | 3/1993 | Liang | |
| 5,244,179 A | * | 9/1993 | Wilson | 251/30.03 |
| 5,431,181 A | * | 7/1995 | Saadi et al. | 137/15 |
| 5,469,586 A | | 11/1995 | Tsutsui et al. | |
| 5,482,250 A | | 1/1996 | Kodaira | |
| 5,508,510 A | | 4/1996 | Laverty, Jr. et al. | |
| 5,549,273 A | * | 8/1996 | Aharon | 251/129.04 |
| 5,699,994 A | | 12/1997 | Wu | |
| 5,769,120 A | | 6/1998 | Laverty, Jr. et al. | |
| 5,806,556 A | | 9/1998 | Johnson | |
| 6,019,343 A | * | 2/2000 | Tsai | 251/30.02 |
| 6,041,809 A | | 3/2000 | Johnson | |
| 6,056,261 A | * | 5/2000 | Aparicio et al. | 251/129.03 |
| 6,161,814 A | * | 12/2000 | Jahrling | 251/129.04 |

* cited by examiner

*Primary Examiner*—Charles R. Eloshway
*Assistant Examiner*—Huyen Le
(74) *Attorney, Agent, or Firm*—Greer, Burns & Crain, Ltd.; Philip M. Kolehmainen

(57) ABSTRACT

A high flow valve assembly and a low flow valve assembly are in parallel flow relation between an inlet and an outlet of a flush controller housing. The valve assemblies are opened by solenoid operated pilot valves under the control of a microprocessor based flush control system. A turbine directly measures flow through the low flow valve assembly and the control system computes flow through the high flow valve assembly to perform a flushing operation including an initial siphon trap flushing high flow portion and a subsequent trap reseal low flow portion. A push button is pressed to one of two override positions either to provide a signal to the control system for a normal flush operation or to open the high flow valve assembly independently of the control system for an emergency flush operation. A user detection system includes a pair of emitters and a pair of detectors defining an array of intersecting detection points in a skewed plane in which the control system can locate the position of a user. The controller can be configured for supplying flush water for either a toilet or a urinal, and for either right or left side water supply entry.

32 Claims, 14 Drawing Sheets

FIG. 7
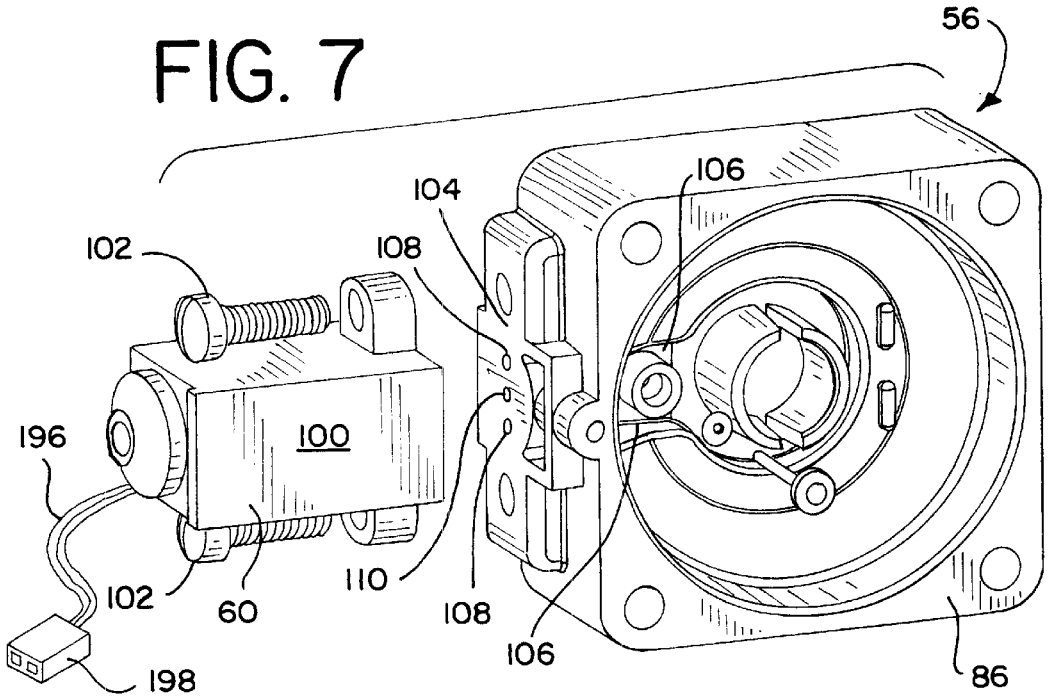
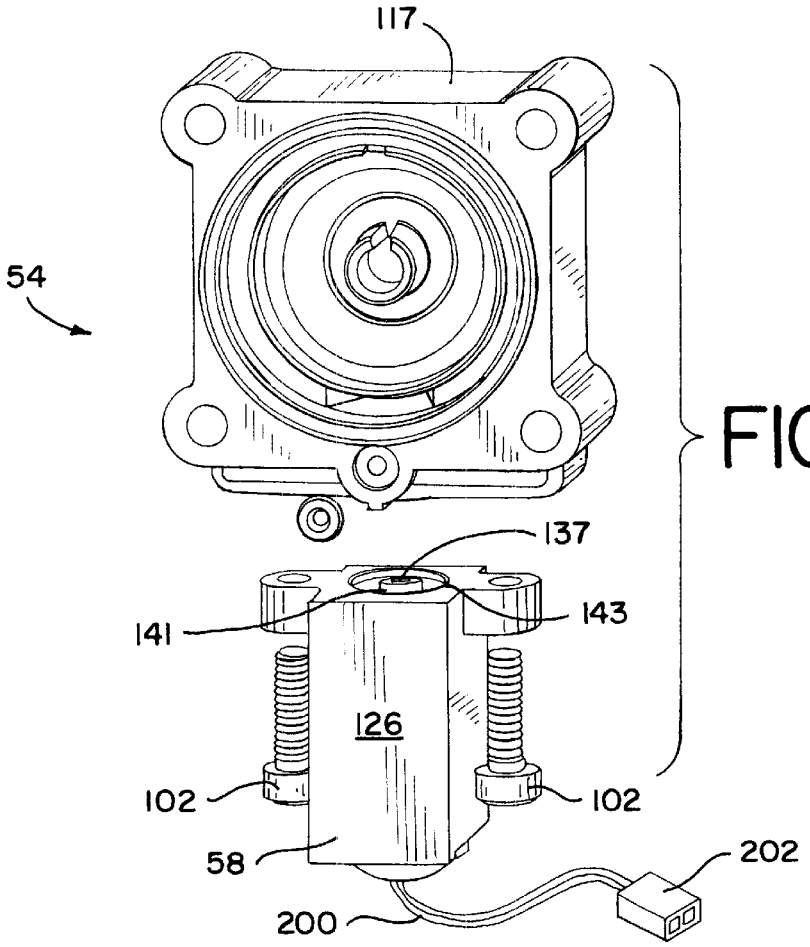
FIG. 8

RATE OF FLOW (GPM)
20
15
10
5
257A
257C
257D
257E
0
5
10
TIME (SEC.)

30
34
28
FLOW SENSOR
216
218
220
222
32
MICROPROCESSOR
33
MEMORY
I.R SENSOR
214
L.E.D.
212
182
187
188
196
H. F. SOL.
60
198
210
204
208
39
36
206
200
L.F. SOL.
58
190
202

FLUSH CONTROLLER

FIELD OF THE INVENTION

The present invention relates to an improved flush controller for toilets and urinals.

DESCRIPTION OF THE PRIOR ART

Known metering valves for flushing toilets and urinals typically include a slow closing valve mechanism for delivering a metered volume of water to a fixture. This type of valve does not achieve precise control of the flow rate or volume. The result can be excessive water consumption and poor flushing performance. To overcome such problems, there have been efforts to directly measure and control water flow in flush controllers.

U.S. Pat. No. 4,916,762 discloses a metered water control system for flush tanks including a water wheel turned by flow through a valve and a mechanical system including a gear and a notched cam for closing the valve after flow of a predetermined quantity of water.

U.S. Pat. No. 4,989,277 discloses a toilet flushing device including a flow rate sensor for detecting a flow rate that is compared with a programmed value read from memory. A flow rate control valve is operated in accordance with the comparison to provide a programmed flow rate pattern.

U.S. Pat. No. 5,806,556 discloses a metering valve including a flow turbine for measuring flow through an opened valve. Rotation of a turbine wheel is transmitted to a cam through a reducing gear assembly and a lost motion connection in order to close the valve after a predetermined flow volume.

U.S. Pat. No. 6,041,809 discloses a flush control valve assembly with a burst valve for providing a larger, siphoning flow and a bypass valve for providing a smaller, trap reseal flow. The duration and flow volume of the larger flow is determined by the characteristics of the burst valve components, and the duration and flow volume of the smaller flow are determined by a flow turbine, a gear assembly and a control mechanism.

U.S. Pat. No. 5,469,586 discloses a flushing device including a microprocessor for operating a single variable flow valve at varied flow rates to provide stepped variations in flow. Flow rate patterns including urinal and toilet flush patterns are stored in memory. Other microprocessor based flushing systems are disclosed in U.S. Pat. Nos. 5,508,510 and 5,769,120.

These prior art arrangements have not solved the problem of precise, adjustable flow control, particularly for siphon flush toilet applications where the fixture is supplied with an initial burst of water for siphon flushing and a subsequent low flow for trap reseal. It would be desirable to provide a flush controller that can accurately measure water flow and that can be precisely controlled to avoid unnecessary water consumption and to provide effective flushing action.

Known automated fixture flushing systems include the capability for sensing the presence of a user. The goal is to determine when use of the sanitary fixture has terminated so that the fixture can be flushed after use.

U.S. Pat. Nos. 4,793,588 and 4,805,247 disclose flush valve systems having an infra red sensor mechanisms including an infra red transmitter and an infra red receiver.

U.S. Pat. No. 5,482,250 discloses a flushing device with first and second infra red sensing systems. One of these systems detects the presence of a user at a sanitary fixture, and the other detects the presence of the hand of a user in a different region and permits the user to manually initiate a flush operation. A refracting element is used to bend the infra red beam a desired angle toward a toiler user region.

U.S. Pat. No. 4,309,781 discloses an automatic flushing system with an infra red light emitting diode light source and a photosensor. A lens system includes a lens angled to prevent false activation from reflective surfaces. Light reflected from the source to the photosensor by a proximate user for a preselected time results in initiation of a flush operation.

Performance of these known systems is inconsistent because the presence and amount of reflected light is dependent on extraneous factors such as reflection characteristics of different types of clothing and the like. Adjustment of sensitivity is necessary. Increased sensitivity can result in false readings, and reduced sensitivity can result in the failure to detect a user when present. It would be desirable to provide a flush controller having a user detection system that operates reliably despite reflectivity variations and that is able not only to detect but also to locate the position of a user.

Manual override of a flush controller has been recognized to be desirable. U.S. Pat. Nos. 5,187,818 and 5,699,994 disclose flushing systems in which a water closet flushing operation can be initiated automatically as a result of sensing the presence of a user or manually by the user pressing a button. U.S. Pat. No. 5,195,558 discloses a flush valve that is normally operated by an electromagnetic valve and is manually operated in the event of a power failure.

It would be desirable to provide a flush controller with two distinct override modes integrated into a single control system so that a normal flush can be initiated manually or so that a high volume flush can be initiated in emergency conditions such as in the absence of electrical power.

Known metering flush controllers of the type including slow acting valve mechanisms can be configured to supply a urinal or a toilet by selecting specific components of the valve mechanism to provide the needed flow characteristic. Known valves of this type can be connected to a water supply at the right or the left side. Electronically operated systems have not had these capabilities. It would be desirable to provide a flush controller that can be configured by the selection, orientation and location of components for toilet or urinal applications with right or left water entry.

SUMMARY OF THE INVENTION

In brief, in accordance with the invention there is provided a flush controller for siphon flushing and resealing the trap of a sanitary fixture. The flush controller includes a housing having an inlet for connection to a water supply and an outlet for connection to the sanitary fixture. A control system includes a microprocessor mounted within the housing. A high flow path extends between the inlet and the outlet, and includes a high flow valve in the high flow path. A first electrical valve operator opens and closes the high flow valve. A low flow path extends between the inlet and the outlet, and includes a low flow valve in the low flow path. A second electrical valve operator opens and closes the low flow valve. The low and high flow paths have flow restrictions with a proportional relationship. A flow sensor in the low flow path measures flow in the low flow path and provides an output signal. Means are included for providing an initiation signal to the control system. The control system includes means for operating the first and second valve operators for opening both the high flow and low flow valves in response to the initiation signal in order to provide a siphon flush flow through the output port. The control system includes means for determining the volume of the siphon flow using the proportional relationship and the output signal, and for operating the first valve operator to close the high flow valve after a first predetermined siphon flow volume to provide a continuing trap reseal flow. The control system includes means for using the output signal to determine the volume of the trap reseal flow and for operating the second valve operator to close the low flow valve after a second predetermined trap reseal flow volume.

In brief, in accordance with another aspect of the invention there is provided a method of controlling a siphon flush flow and a trap reseal flow to a sanitary fixture. The method includes opening both a high flow valve and a low flow valve disposed in parallel high and low flow paths between a water supply and the sanitary fixture, sensing flow through the low flow path, determining the sum of the flows through the low and high flow paths using the sensed flow through the low flow path and using a proportional flow restriction relationship of the high and low flow paths; and closing the high flow valve when the sum of the flows through the low and high flow paths reach a volume equal to a desired siphon flush flow volume.

In brief, in accordance with another aspect of the invention there is provided a flush controller for a sanitary fixture including a housing having an inlet for connection to a water supply and an outlet for connection to the sanitary fixture. A valve controls flow from the inlet to the outlet. A control system operative in response to an initiation signal opens the valve to initiate a flushing operation. A user sensing system detects the presence of a user of the sanitary fixture. The user sensing system includes a plurality of radiation emitters and a plurality of radiation detectors. Means connected to the detectors responds to radiation reflected by a user from the emitters to the detectors for providing the initiation signal. The emitters are aimed along discrete and spaced apart emission lines extending away from the housing. The detectors are also aimed along discrete and spaced apart detection lines extending away from the housing. Each of the emission lines intersects each of the detection lines.

In brief, in accordance with another aspect of the invention there is provided a flush controller for a sanitary fixture including a housing having an inlet for connection to a water supply and an outlet for connection to the sanitary fixture. A valve controls flow from the inlet to the outlet. A user sensing system detects the presence of a user of the sanitary fixture and provides a flush initiation signal. A control system operative in response to the initiation signal opens the valve to initiate a flushing operation. An override control system includes a manually operable member, the manually operable member being mounted for movement from a normal, standby position to first and second different override positions. A sensing device in the housing detects movement of the manually operable member to the first override position and provides an override flush signal. The control system is operative in response to the override flush signal for opening the valve to initiate a flushing operation. The manually operable member is connected to the valve independently of the control system for opening the valve in response to movement of the manually operable member to the second override position.

In brief, in accordance with another aspect of the invention there is provided a method for adapting a flush controller for toilet and urinal applications and for right or left water supply installations. The flush controller has a valve assembly including a valve body with a vertically extending outlet port and a horizontally extending inlet port and a low flow valve located at a first region of the valve assembly. A high flow valve receiving location is at a second region of the valve assembly, and a override switch receiving location is at a third region of the valve assembly. The low flow valve has a low flow valve electrical connector. The flush controller optionally has a high flow valve with a high flow valve electrical connector at the high flow valve receiving location and optionally has an override switch with a switch connector at the override switch receiving location. The flush controller further has an electrical circuit board including a plurality of electrical terminals arrayed at spaced locations over the surface of the circuit board. The method includes omitting the high flow valve for urinal applications and mounting the high flow valve at the high flow valve receiving location for toilet applications. The valve assembly is rotated around a vertical axis to point the inlet port either to the right or the left. The low flow valve electrical connector is connected to circuit board terminals adjacent the first region of the valve assembly and, if the high flow valve is present, then the high flow valve electrical connector is connected to circuit board terminals adjacent the second region of the valve assembly.

BRIEF DESCRIPTION OF THE DRAWING

The present invention together with the above and other objects and advantages may best be understood from the following detailed description of the preferred embodiment of the invention illustrated in the drawings, wherein:

FIG. 7 is an exploded isometric view of the high flow valve body and solenoid;

FIG. 8 is an exploded isometric view of the low flow valve body and solenoid;

DETAILED DESCRIPTION OF THE PREFERRED EMBODIMENTS

Figure 1:
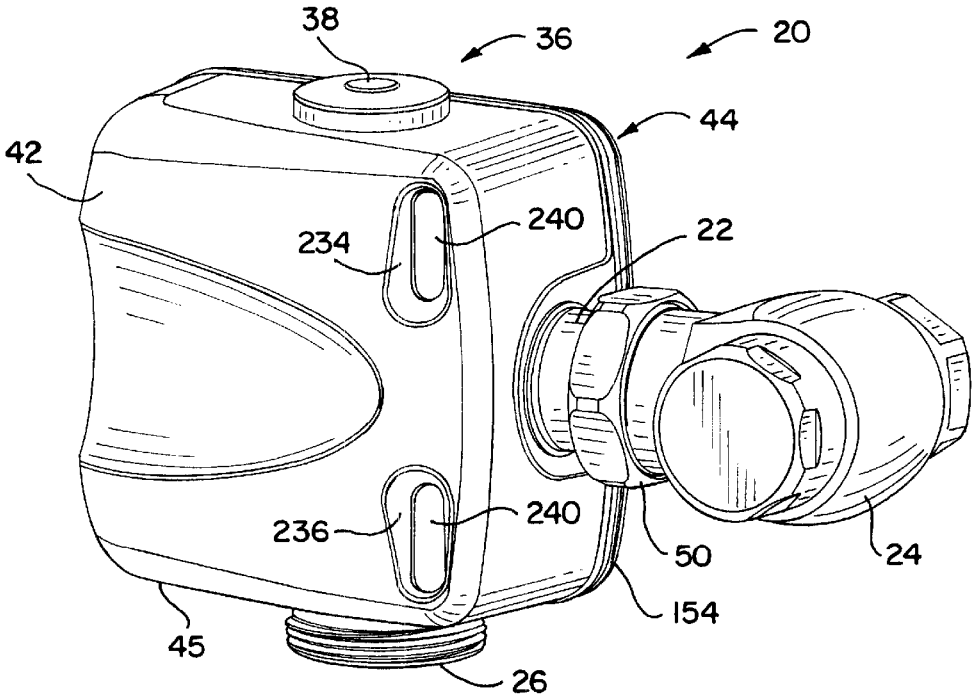
FIG. 1 is an isometric front and side view of a flush controller constructed in accordance with the present invention.
Figure 2:
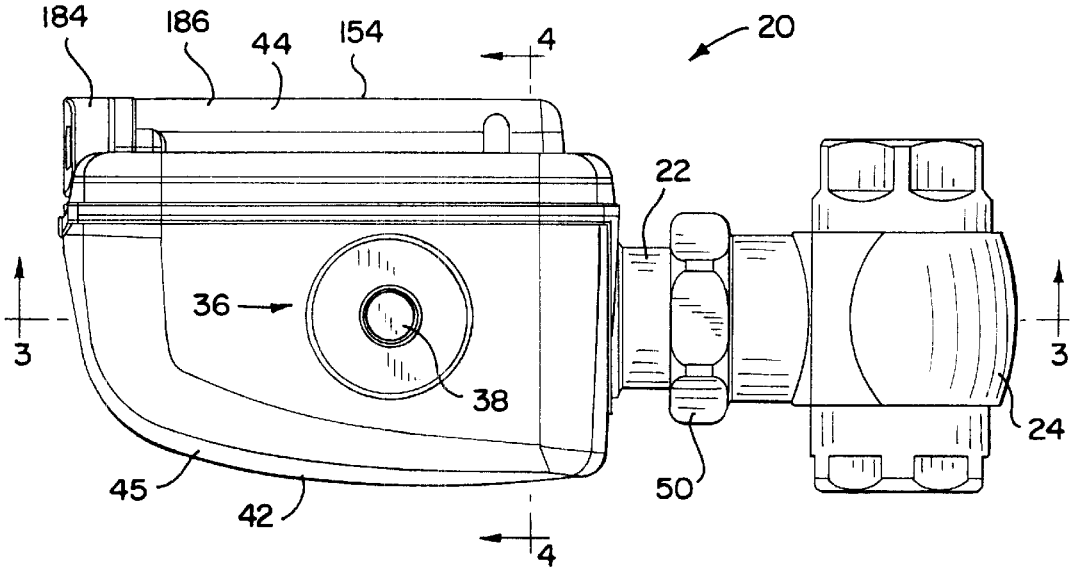
FIG. 2 is a top view of the flush controller.
Figure 3:
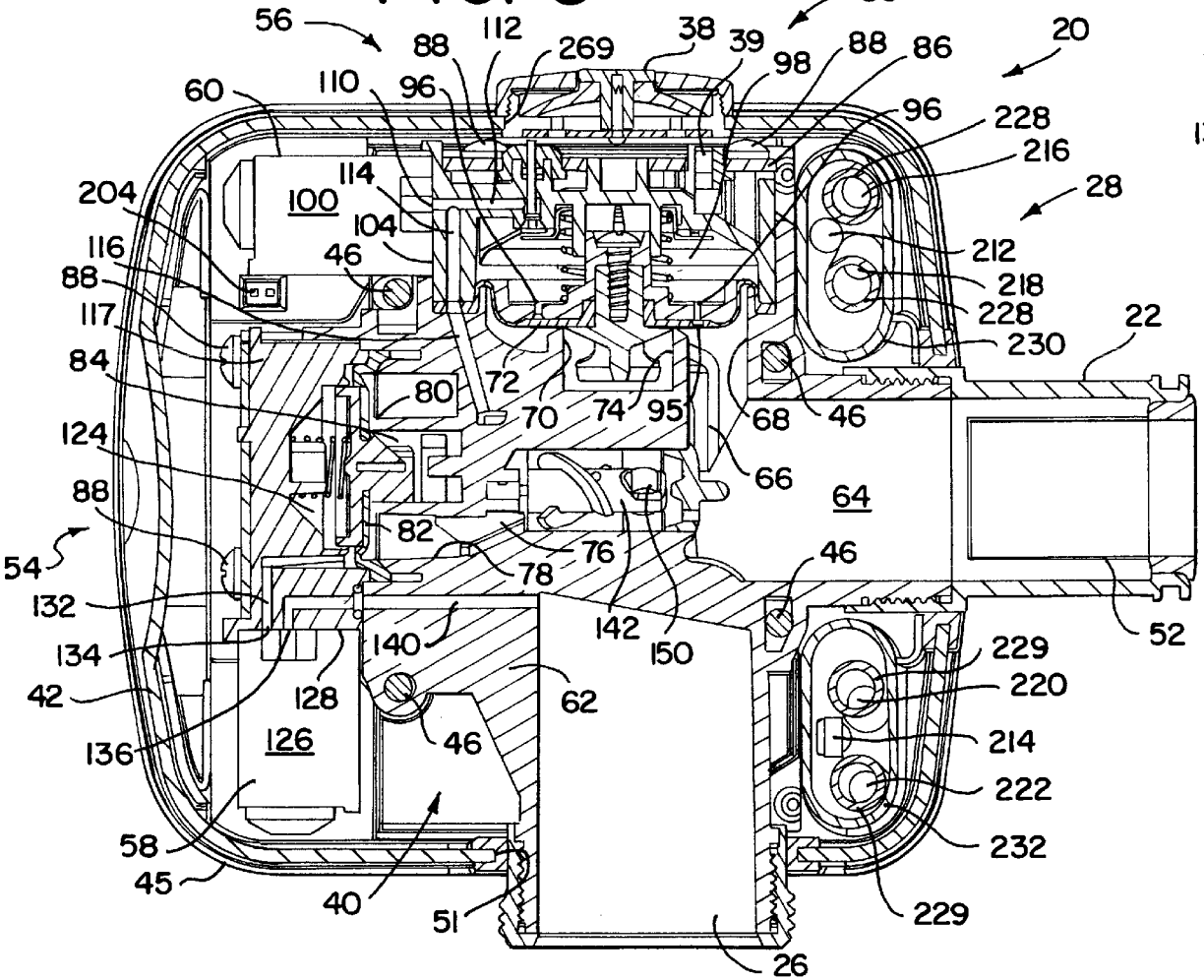
FIG. 3 is a cross sectional view of the flush controller taken along the line 3—3 of FIG. 2, with the control stop omitted.

Having reference now to the drawings and initially to FIGS. 1–3 there is illustrated a flush controller constructed in accordance with the principles of the present invention and designated as a whole by the reference character 20. The flush controller 20 includes an inlet port 22 connected by a manually adjustable control stop 24 to a supply of pressurized water, and an outlet port 26 that is connected to a sanitary fixture, such as a urinal or toilet.

The flush controller 20 supplies water for flushing either a urinal or a toilet in a non-residential application, for example a hotel, stadium, airport, or other location where a high volume water supply is present and a gravity flush tank is not needed. In a urinal application the flush controller 20 delivers a measured quantity of water at a constant flow rate during each flush cycle. For a siphon jet or blow out toilet fixture, the flush controller 20 initially delivers a short burst of water at a high flow rate to flush the fixture, and then delivers a measured volume of water at a lower flow rate to reseal the fixture trap.

Figure 9:
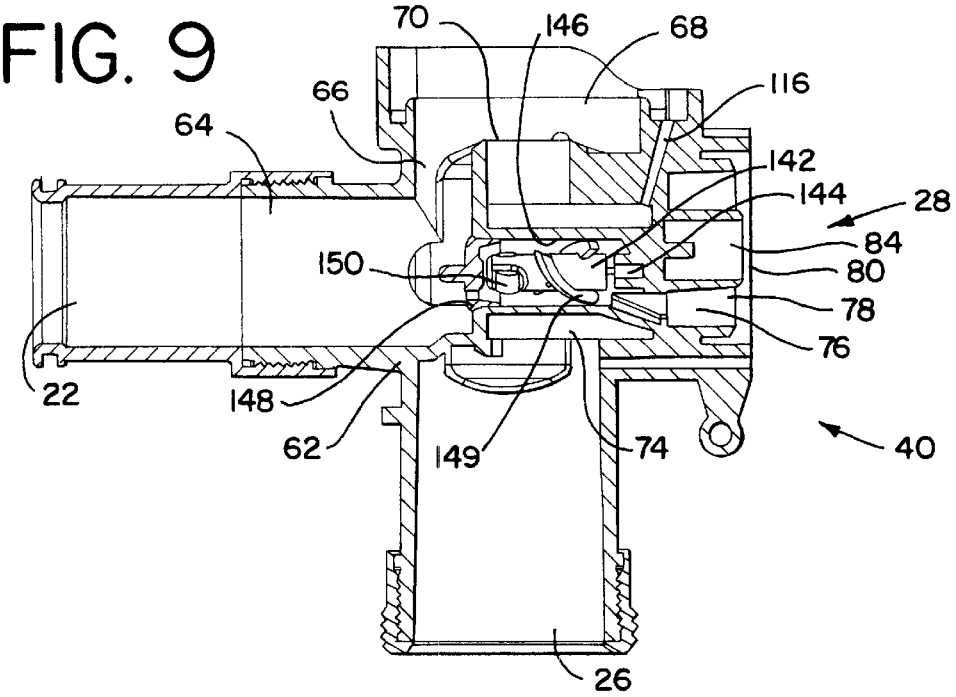
FIG. 9 is a cross sectional view of the body of the valve body assembly, taken along a central plane of the body and from a direction opposite to the cross sectional view of FIG. 3.

An automatic flush control system 30 including a microprocessor 32 including and/or having access to a memory 33 (FIG. 15) cooperates with a user detection system 34 (FIGS. 4, 13, 15, 21 and 22) for initiating and controlling a flush cycle after use of the fixture. A flow sensing assembly 28 (FIGS. 3, 9 and 15) provides a flow rate signal to the flush control system 30. A manually operated flush override control 36, including a pushbutton 38 and an override switch 39 (FIGS. 3 and 15–19), permits the user to override the automatic system 30 and initiate a normal flush operation or, alternatively, to operate the flush controller in a continuous high flow condition for setup or emergencies such as circuit or battery failure.

In general, the flush controller 20 includes a valve body assembly 40 sandwiched between a front cover 42 and a back plate assembly 44 (FIG. 5) cooperating to define a housing 45 (FIG. 1). Fasteners 46 hold the assembly 40, the front cover 42 and a gasket 48 in place. The gasket 48 includes lobes 48A and 48B (FIG. 5) for sealing around the inlet and outlet ports 22 and 26. The inlet port 22 is provided with a strainer filter 52. The manually adjustable control stop 24 (FIGS. 1 2 and 5) is mounted to the inlet port 22 by a coupling nut 50 and can be used for setting the maximum flow rate through the flush controller to achieve a high flow rate while avoiding splashing in the sanitary fixture. The outlet port 26 extends downwardly through an opening 51 in the bottom wall of the front cover 42 (FIG. 3).

Water flows from the inlet port 22 to the outlet port 26 along two parallel flow paths, one including a low flow valve assembly 54 and the other including a high flow valve assembly 56. These valve assemblies are operated respectively by low and high flow solenoid pilot valves 58 and 60. Referring to FIG. 3, a body 62 of the valve body assembly 40 includes an inlet chamber 64 communicating with the inlet port 22. A passage 66 extends from the chamber 64 to a high flow valve cavity 68 including a high flow valve seat 70. Flow through the seat 70 is normally prevented by a resilient high flow valve member 72 engaged with the seat 70. When the high flow valve member 72 is moved to an open position, water flows through an outlet passage 74 to the outlet port 26.

Another passage 76 extends from the inlet chamber 64 to a low flow valve cavity 78 including a low flow valve seat 80. Flow through the seat 80 is normally prevented by a resilient low flow valve member 82 engaged with the seat 80. When the low flow valve member 82 is moved to an open position, water flows through an outlet passage 84 to the outlet port 26.

The high flow valve cavity 68 is defined between the valve body 62 and a high flow valve cap 86 attached by fasteners 88. A diaphragm backing plate 90 overlies the high flow valve member 72, and a spring 92 in compression between the plate 90 and a spring seat 94 applies a force to initially close the valve member 72 in sealing relation against the high flow valve seat 70. When pressurized water is present at the inlet port 22, passage 66 and cavity 68, a restricted passage 95 in the valve member 75 communicating with apertures 96 in the plate 90 admits pressurized liquid to a control chamber region 98 above the valve member 72. Because the outlet passage 74 is at low pressure, the force differential across the valve member 72 resulting from pressurization of the control chamber 98 normally holds the valve member 72 against the valve seat 70 and prevents flow through the high flow valve assembly 56.

The high flow solenoid pilot valve 60 is energized by the control system 30 to open the high flow valve assembly 56. A high flow solenoid housing 100 is held by fasteners 102 against a wall 104 of the valve body 62. Normally the high flow solenoid pilot valve 60is in a closed condition. When the solenoid pilot valve 60 is energized, the solenoid pilot valve 60 is operated to an open position, permitting flow. A pair of upstream passages 106 extend from the normally pressurized control chamber 98 to control chamber ports 108 in the wall 104. A discharge port 110 in the wall 104 is spaced from the ports 108 and communicates with the outlet port 26 through intersecting passages 112 and 114 in the valve cap 86 and a passage 116 in the valve body 62. Energization of the solenoid pilot valve 60 interconnects ports 108 and 110 and vents the control chamber 98 to the outlet port 26 through passages 106, 108, 112, 114 and 116. The decrease in pressure in the control chamber 98 permits inlet pressure in the cavity 68 to move the valve member 72 to an open position, spaced away from the valve seat 70, and water flows at a high flow rate from the inlet port 22 to the outlet port 26 through the high flow valve assembly 56.

The low flow valve cavity 78 is defined between the valve body 62 and a low flow valve cap 117 attached by fasteners 88. A backing plate 118 overlies the low flow valve member 82, and a spring 120 in compression between the plate 90 and the cap 117 applies a force to initially close the valve member 82 in sealing relation against the low flow valve seat 80. When pressurized water is present at the inlet port 22, passage 76 and cavity 78, a restricted bleed passage 122 in the valve member 82 admits pressurized liquid to a control chamber region 124 behind the valve member 82. Because the outlet passage 84 is at low pressure, the force differential across the valve member 82 resulting from pressurization of the control chamber 124 normally holds the valve member 82 against the valve seat 80 and prevents flow through the low flow valve assembly 54.

The low flow solenoid pilot valve 58 is energized by the control system 30 in order to open the low flow valve assembly 54. A low flow solenoid housing 126 is held by fasteners 102 against a wall 128 of the valve body 62. Normally the low flow solenoid pilot valve 58 is in a closed condition. When the solenoid pilot valve 58 is energized, the solenoid pilot valve 58 is operated to an open position, permitting flow. An upstream passage 132 extends from the normally pressurized control chamber 124 to a control chamber port 134 in the wall 128. A discharge port 136 in the wall 128 is spaced from the port 134 and communicates with the outlet port 26 through passages 138 and 140 in the valve cap 117 and the valve body 62. Energization of the solenoid pilot valve 58 interconnects ports 134 and 136 and vents the control chamber 124 to the outlet port 26 through passages 138 and 140. The decrease of pressure in the control chamber 124 permits inlet pressure in the cavity 78 to move the valve member 82 to an open position, spaced away from the valve seat 80, and water flows at a low flow rate from the inlet port 22 to the outlet port 26 through the low flow valve assembly 54.

Figure 26:
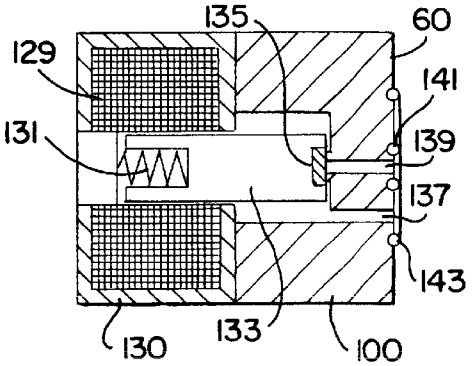
FIG. 26 is a simplified cross sectional view of a solenoid pilot valve of the flow controller.

FIG. 26 illustrates the high flow solenoid valve 60. The low flow solenoid valve 58 is of the same construction. The housing 100 of the solenoid valve 60 supports a solenoid winding 129 on a spool 130. A spring 131 normally holds a plunger 133 in sealing relation against a valve seat 135. When the solenoid winding 129 is energized the plunger 133 is pulled away from the seat 135 to permit flow from an inlet port 137 to an outlet port 139. Concentric O-rings 141 and 143 isolate the ports 137 and 139 from one another when the body 100 is mounted against a flat wall surface.

The flow sensing assembly 28 (FIG. 9)detects the volume of flow and the rate of flow through the low flow valve assembly 54. The assembly 28 is a turbine meter system including a turbine spool 142 mounted for rotation on an axially extending support pin 144 within a turbine chamber 146. The chamber 144 is located in the flow path between the inlet chamber 64 and the passage 76. An apertured plate 148 restricts the flow of water and directs the flow toward spiral blades 149 on the spool 142. When water flows through the chamber 146, the spool 142 rotates at a speed directly proportional to the flow rate over a wide range of water pressure and flow rates. A magnet 150 is carried by the spool 142, and a Hall effect sensor 152 (FIG. 10) in close proximity to the magnet 150 provides an output signal to the flush control system 30 for each rotation of the turbine spool.

Figure 11:
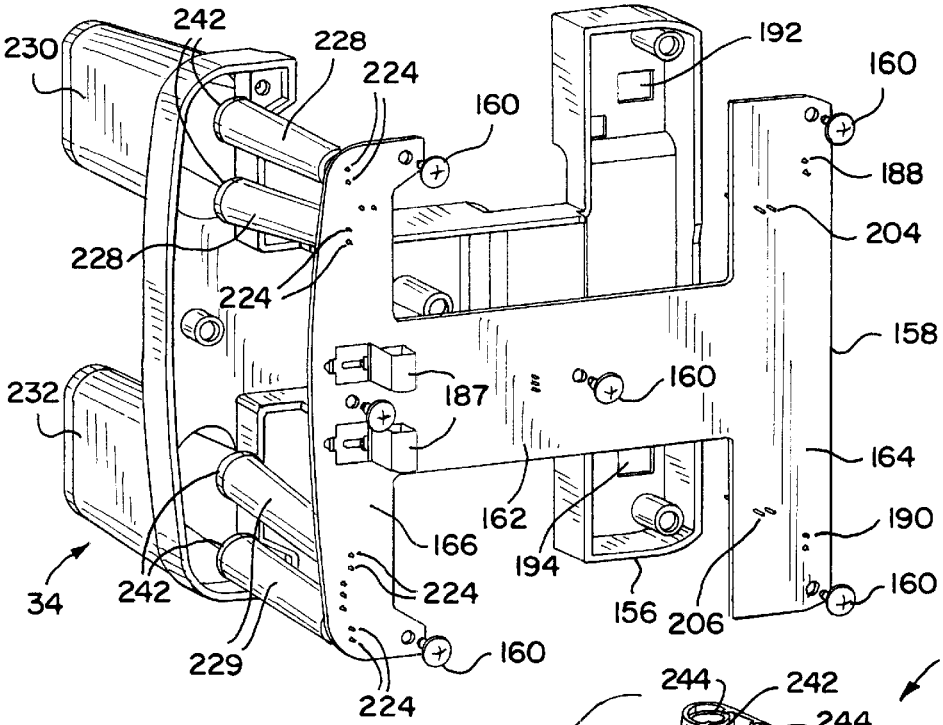
FIG. 11 is an exploded rear isometric view of the electronics enclosure of the back plate assembly.
Figure 12:
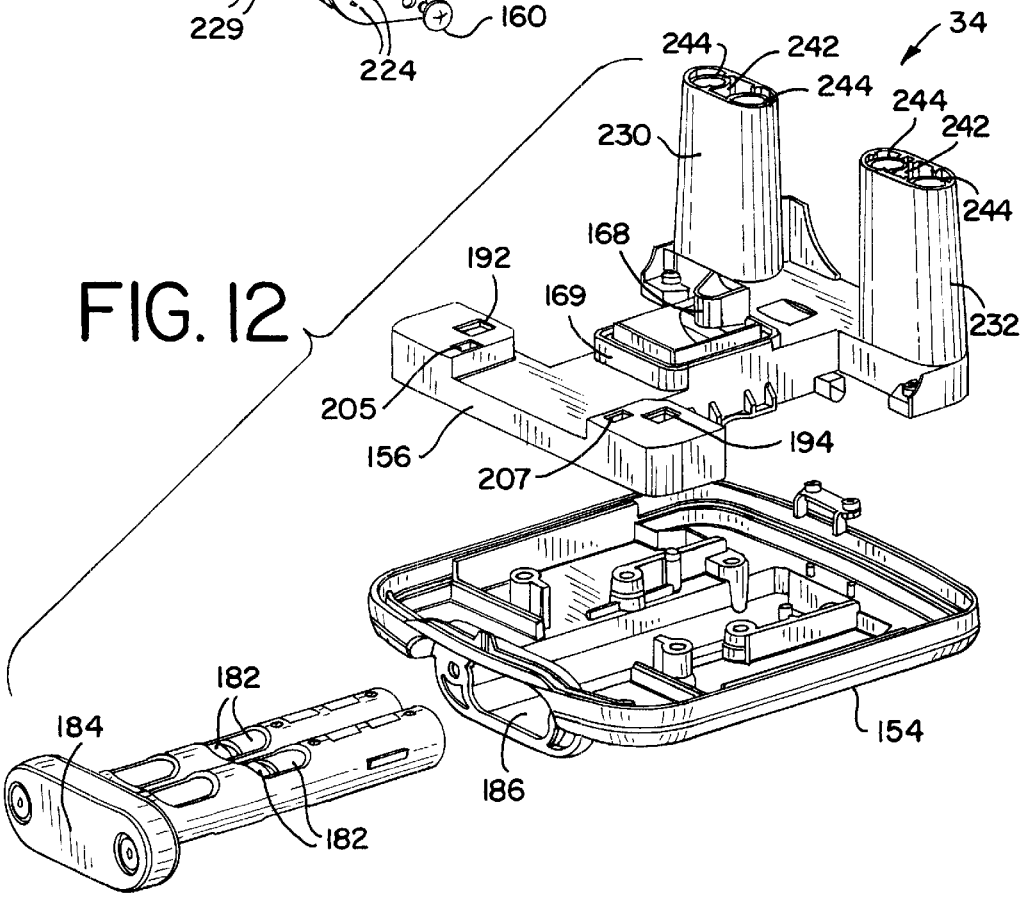
FIG. 12 is an exploded isometric view of the back plate assembly of the flow controller.

The back plate assembly 44 (FIGS. 10–12) includes a back cover 154 and an electronics enclosure 156. A circuit board 158 and the enclosure 156 have complementary H shapes and the board 158 is attached to the rear of the enclosure 156 by fasteners 160 (FIG. 11). The board 158 has a central portion 162 supporting circuit components including the microprocessor 32 and the Hall effect sensor 152, and the central portion 162 is flanked by elongated side leg board portions 164 and 166. The Hall effect sensor 152 is positioned at an elevated, central position above the surface of the board 158, and when the board 158 is secured to the electronics enclosure 156, the sensor 152 is received in a forwardly projecting sensor well 168 formed on a pedestal 169 as an integral portion of the enclosure 156.

The body 62 of the valve body assembly 40 has open windows 170 formed in its opposite sides. As seen by comparing FIGS. 5 and 6, the window 170 at the front side of the body 62 is closed by a bulkhead member 172 and gasket 174 held in place by fasteners 176. Fasteners 178 (FIG. 5) attach the back plate assembly 44 with the enclosed circuit board 158 to the valve body assembly 40. When the assembled back plate assembly 44 is mated with the valve body assembly 40, the sensor well 168 and the pedestal 169 enter the window 170 at the back side of the body 62. A second gasket 174 (FIG. 5) provides a seal between the pedestal 169 and the window 170. In this mated position, the sensor well 168 and the Hall effect sensor 152 in the well are located immediately adjacent to the rotational path of the magnet 150 as the turbine spool 142 is rotated by the flow of water through the low flow valve assembly 54. The sensor 152 provides an output pulse for each rotation of the turbine spool 142.

Power for the flush controller 20 is provided by batteries 182 held in a battery cartridge 184. The cartridge 184 is slideably received in a battery chamber 186 formed in the rear of the back cover 154. When cartridge 184 is installed, contact is made with a pair of battery terminals 187. The terminals 188 are mounted upon the rear surface of the circuit board 158 at the intersection of the central portion 162 and the side leg 166, and extend rearwardly into the chamber 186.

Figure 15:
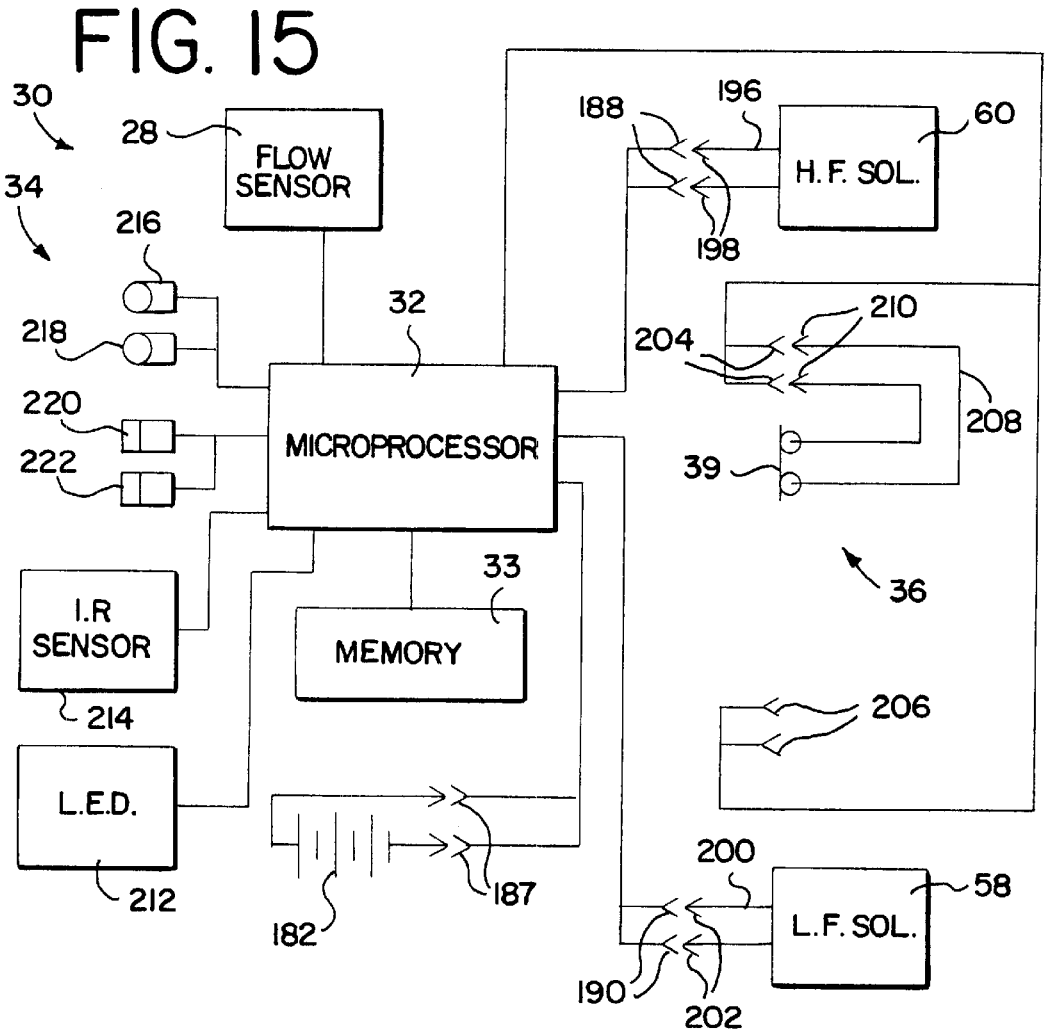
FIG. 15 is a schematic block diagram of the microprocessor based flush control system of the flush controller.
Figure 16:
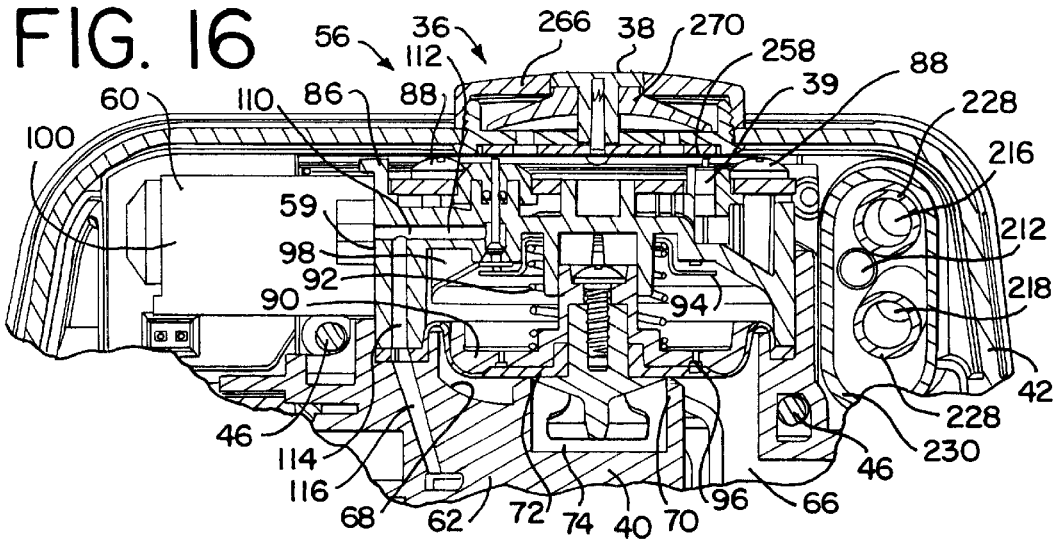
FIG. 16 is an enlarged fragmentary cross sectional view, similar to the upper portion of FIG. 3, showing the high flow valve assembly in its closed condition and the override control in a standby, non-actuated condition.

Pairs of solenoid terminal pins 188 and 190 are supported by the circuit board 158 near the opposite ends of the side leg 164. These contacts are accessible through access ports 192 and 194 in the front wall of the electronics enclosure 156. With the back plate assembly 44 installed in the orientation seen in FIGS. 3, 5 and 6, the terminal pins 188 and the port 192 are located near the top of the flow controller 20 and the terminal pins 190 and the port 194 are located near the bottom of the flow controller 20. The high flow solenoid 60 has a cable 196 terminating in a female connector 198 seen only in FIG. 7. The connector 198 is mated with the terminal pins 188 in order to connect the solenoid 60 into the flush control system 30 (FIG. 15). The high flow solenoid 60 is positioned near the top of the flush controller 20, and the cable 196 is not long enough to reach the lower pin terminals 190. The low flow solenoid 58 has a cable 200 terminating in a female connector 202 seen only in FIG. 8. The connector 202 is mated with the with the terminal pins 190 in order to connect the solenoid 58 into the flush control system 30. The low flow solenoid 60 is positioned near the bottom of the flush controller 20, and the cable 200 is not long enough to reach the upper pin terminals 188. As a result of the orientation of the components and the length of cables 196 and 200, the solenoids 58 and 60 (in the configuration of FIG. 5) are only capable of being connected in this one, unique way to the circuit board 158.

Two pairs of override switch terminal pins 204 and 206 are also supported by the circuit board 158 along the side leg 164. The pins 204 are located near the solenoid terminal pins 188 at the top of the flow controller 20, and the pins 206 are located near the solenoid terminal pins 190 at the bottom of the flow controller 20. The terminal pins 204 and 206 are accessible through access ports 205 and 207 in the front wall of the electronics enclosure 156. A cable 208 terminating in a female connector 210 is connected to the override switch 39. With the back plate assembly 44 installed in the orientation seen in FIGS. 3, 5 and 6, the connector 210 is mated with the terminal pins 204 in order to connect the override switch 39 into the flush control system 30 (FIG. 15). The cable 208 is not long enough to permit the connector 210 to reach the lower terminal pins 204, and the connection can only be made in one way.

An LED light source 212 is supported on the side leg 166 of the circuit board 158. The LED 212 is energized, preferably in a flashing mode, by the flush control system 30 to provide an indication of the need for replacement of the batteries 182 near the end of their battery life. An infra red sensor 214 is also supported on the side leg 166 of the circuit board 158. The sensor 214 can be used to receive infra red signals from an infra red emitter associated with a remote device.

Figure 4:
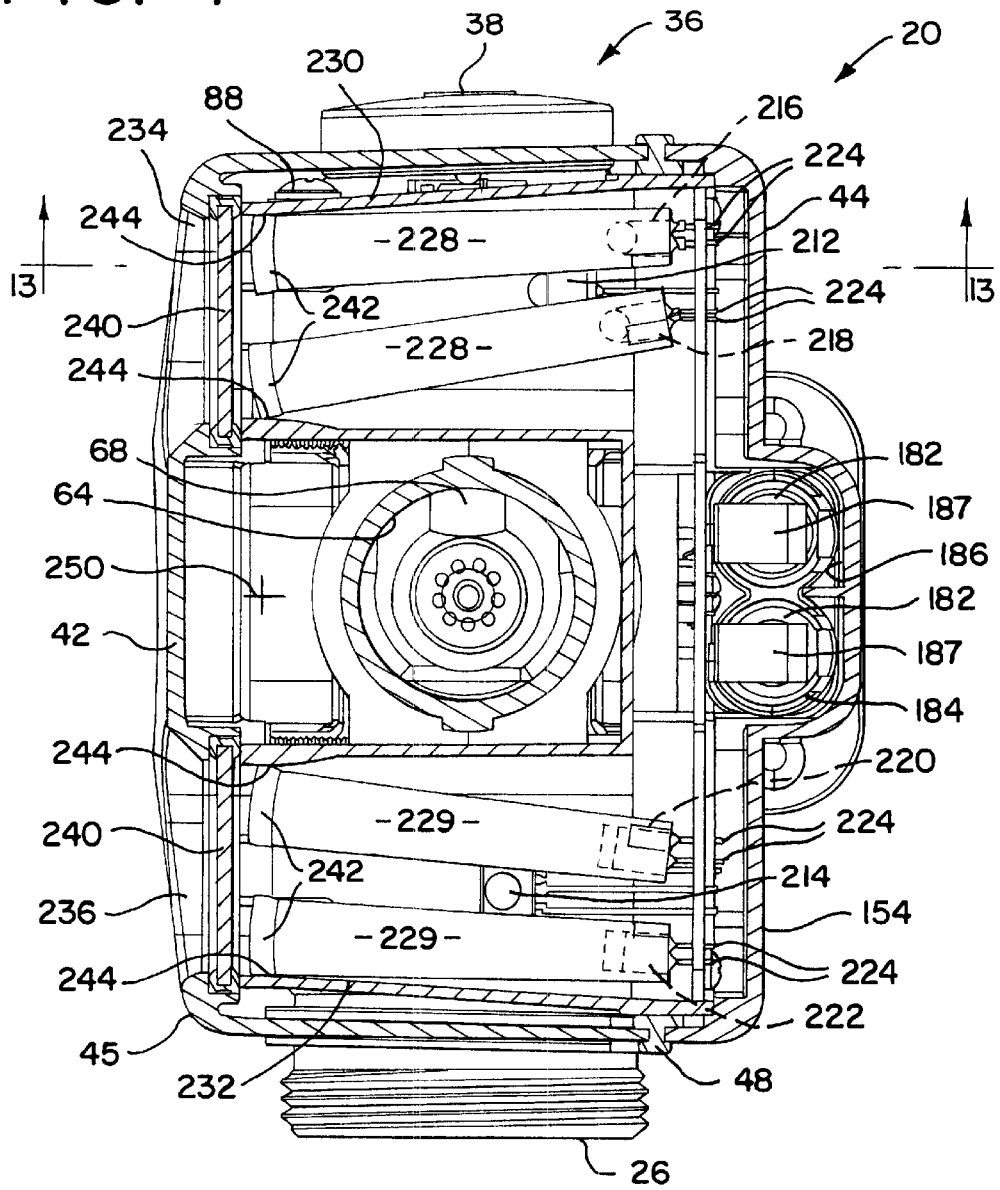
FIG. 4 is a cross sectional view of the flush controller taken along the line 4—4 of FIG. 2.
Figure 13:
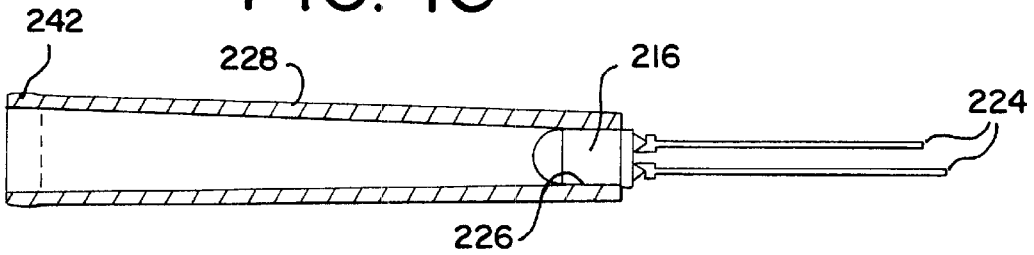
FIG. 13 is an enlarged cross sectional view of an infra red emitter and sight tube, taken along the line 13—13 of FIG. 4.

The user detection system 34 includes a pair of infra red emitters 216 and 218 and a pair of infra red detectors 220 and 222 seen in broken lines in FIG. 4. The emitters 216, 218 and the detectors 220, 222 have leads 224 that are connected to the side leg portion 166 of the circuit board 158. The emitters and detectors 216, 218, 220 and 222 can be directly connected to the circuit board 158 by through hole soldering as shown, or alternatively may be socketed or connected directly or indirectly by other techniques such as surface mounting. Each emitter 216 is received in a neck portion 226 of an elongated, slightly tapered sight tube 228 (FIG. 13). Each detector 220, 222 is received in a neck portion 226 of an elongated slightly tapered sight tube 229. The emitters 216, 218 with their corresponding sight tubes 228 are located within the base of a first open topped support tower 230 formed as part of the electronics enclosure 156 (FIG. 4). The detectors 220, 222 with their corresponding sight tubes 229 are located within the base of another open topped support tower 232 also formed as part of the electronics enclosure 156.

A pair of windows 234 and 236 are formed in the front cover 42 at the front of the flush controller 20. The open tops of the towers 230 and 232 are aligned with the windows 234 and 236. To maintain a sealed environment within the flush controller 20, a transparent window panel 240 is received in each window 234 and 236. The sight tubes 228 and 229 within the towers 230 and 232 are directed along lines extending from the emitters and detectors 216, 218, 220, 222 through the windows 234 and 236. Under the control of the flush control system 30, light is emitted from the emitters 216, 218 to the region in front of the flush controller 20 through the sight tubes 228 and window 234. When a user of the flush controller 20 is in this region, light is reflected to the detectors 220, 222 through the window 236 and sight tubes 229. The light reflection information is used by the flush control system 30 to initiate a flush cycle after use of the sanitary fixture.

The sight tubes 228, 229 narrowly focus the emitters 216, 218 and the detectors 220, 222. Each sight tube 228, 229 is provided with a bead portion 242 at the open ends opposite the necks 226. These beads 242 are in the shape of part of a sphere. The beads 242 are received between ribs 244 (FIG. 4) in the towers 230 and 232 in a connection that permits each sight tube 228, 229 to pivot around its forward end. The pivot points defined by the beads 242 of the sight tubes 228 and 229 are approximately aligned in a common plane.

The pivotal mounting of the sight tubes 228, 229 provides an advantage in the design and manufacture of the flush controller 20 because the sight tubes 228, 229 can be aimed to optimize the performance of the user detection system 34. When the leads 224 are positioned and secured upon the circuit board 158, for example by soldering or by insertion into sockets soldered to the board, the positions of the sight tubes 228, 229 are fixed. In the design of the board, the mounting positions on the circuit board 158 are located in order to obtain the desired sight or focus lines for light emitted from the emitters 216, 218 and for light reflected toward the detectors 220, 222. Changing the sight lines requires only a change in the circuit board mounting locations.

Figures 21, 22, 24:
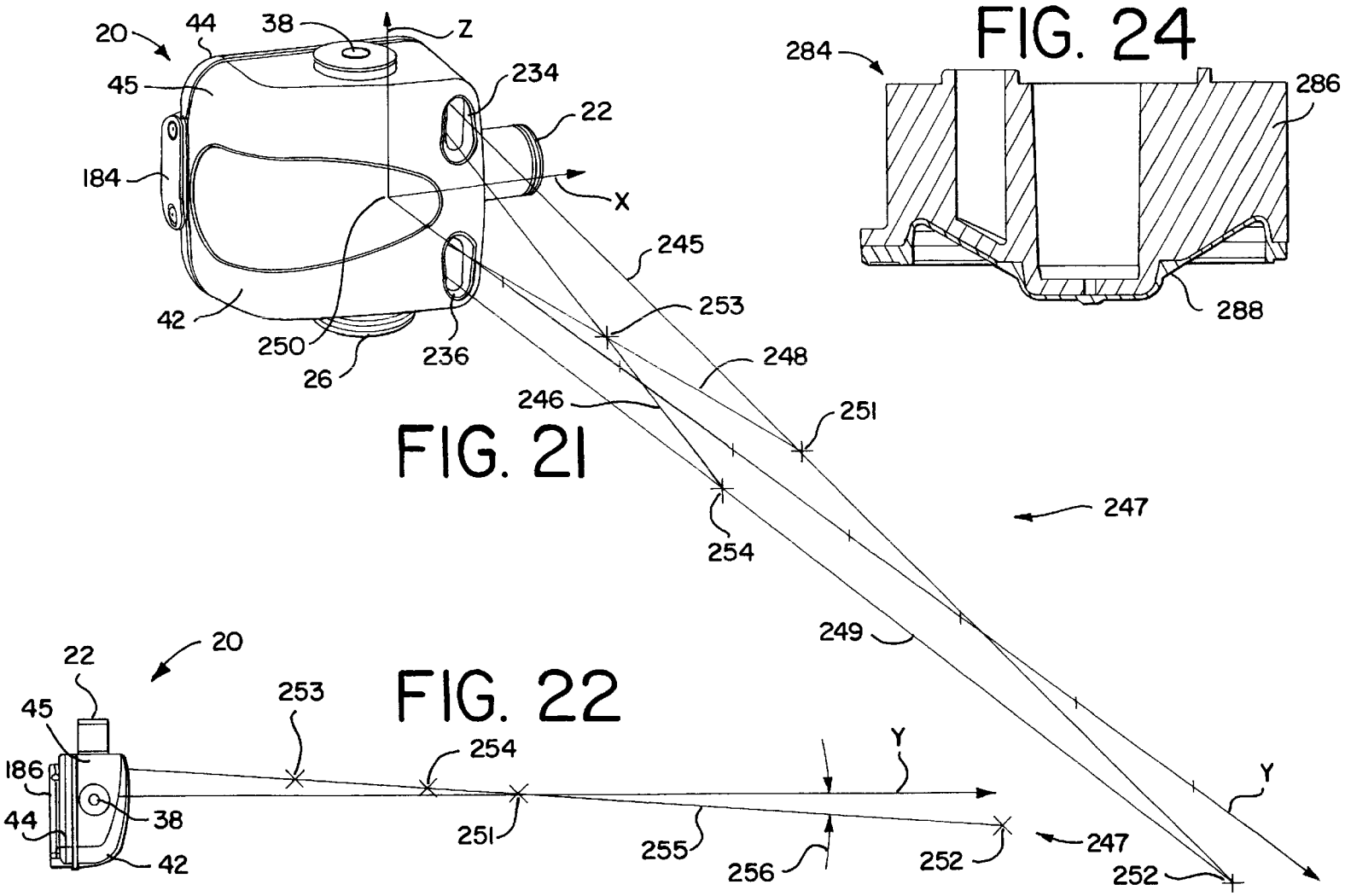
FIG. 21 is an isometric view of the flush controller showing the focus lines of the emitters and detectors of the user detection system.
FIG. 22 is a top view on a reduced scale of the flush controller and focus lines of FIG. 21.
FIG. 24 is a vertical cross sectional view of a valve body plug assembly used when the flush controller is configured to flush a urinal as seen in FIG. 23.

As seen in FIG. 21, focus lines 245 and 246 respectively for the emitters 216 and 218 pass outwardly through the window 234 into a user detection region 247 in front of the flush controller 20. Focus lines 248 and 249 respectively for the detectors 220 and 222 pass through the window 236 into the user detection region 247. The lines 245, 246, 248 and 249 are arrayed in space in a rectilinear X-Y-Z coordinate system indicated by X, Y and Z arrows in FIG. 21. The origin 250 of these coordinates is located approximately in the same general plane as the pivot points of the sight tubes 228, 229 (FIG. 4) and is also located at the intersection of the axes of the inlet port 22 and the outlet port 26. The X axis extends from the origin 250, side to side with respect to the housing 45, along the axis of the inlet port 22. The Z axis extends from the origin 250, up and down with respect to the housing 45, along the axis of the outlet port 26. The Y axis extends from the origin 250 forward from the housing 45 and into the user detection region 247.

The focus lines 245 and 246 for the emitters 216 and 218 diverge at a small angle. The focus lines 248 and 249 for the detectors 220 and 222 also diverge at a small angle. The focus line 245 for the emitter 216 intersects the focus line 248 for the detector 220 at an intersection point 251 and intersects the focus line 249 for the detector 222 at an intersection point 252. The focus line 246 for the emitter 218 intersects the focus line 248 for the detector 220 at an intersection point 253 and intersects the focus line 249 for the detector 222 at an intersection point 254. The emitters 216 and 218 and the detectors 220 and 222 are aimed and focused by the sight tubes 228 and 229 along narrow paths centered on the lines 245, 246, 248 and 249. These narrow paths intersect at tightly defined regions centered on the intersection points 251, 252, 253 and 254. Therefore the paths and intersection regions can be considered for purposes of description to be lines and points.

The flush control system 30 periodically energizes the emitter 216 to direct infrared light along the line 251. Simultaneously the control system 30 interrogates the detectors 220 and 222 for the presence of infra red light. The flush control system 30 also periodically energizes the emitter 218 to direct infra red light along the line 251. Simultaneously the control system 30 interrogates the detectors 220 and 222 for the presence of infra red light. When a user is present in the user detection region 247, infra red light is reflected by the user from the emitter 216 at points 251 and/or 252, and/or infra red light is reflected by the user from the emitter 218 at points 253 and 254. Reflected light from points 253 and 251 is detected by the detector 220 and reflected light from points 254 and 252 is detected by the detector 222.

Using a triangulation ranging approach, the flush control system 30 detects the presence and the location of a user in the user detection region 247. The relative strengths of the reflected signals from the scattered points 251–254 provides information from which the placement of a user in the region 247 is determined. This information is used by the control system 30 to initiate a flush cycle at appropriate times, for example when a user enters the region 247, remains for a period of time, and then leaves the region 247. The control system 30 uses ratios of relative reflected signal strength rather than simple magnitude alone. The use of ratios of reflection magnitudes from the pattern of points 251-254 renders the system relatively independent of sensitivity, and substantially cancels out the effect of reflection variations of different clothing fabrics and the like. The need for field calibration of the user detection system 34 is eliminated or reduced.

As can be seen in the top view of FIG. 22, all four focus lines 245, 246, 248 and 249, and thus all four intersection points 251, 252, 253 and 254 lie in a common, generally vertically oriented, user detection plane 255 in the user detection region 247. This user detection plane is skewed with respect to the principal front-to back axis of the flush controller housing 45. As seen in FIG. 22, the plane 255 is offset a skew angle 256 from the Y axis and from the vertical plane defined by the Y and Z axes. In a preferred embodiment of the invention the angle 256 is four degrees. The skew angle 256 prevents false signal reflections from surfaces perpendicular to the Y axis, such as the surface of a door of a toilet stall.

In response to predetermined signals from the infra red detectors 220 and 222, a flush cycle is automatically commenced by the flush controller 20 under the control of the flush control system 30. In a flush cycle for a toilet fixture, the flush controller delivers to the outlet port 26 a precisely metered volume of water including an initial short burst of water at a high flow rate to flush the fixture, followed after a period of transition by a delivery of water at a low flow rate to reseal the fixture trap. The initial short burst is provided by opening both the high flow valve assembly 56 and the low flow valve assembly 54. The high flow valve assembly 56 is then closed while the low flow valve assembly remains open to provide the low flow for resealing the fixture trap.

Figure 14:
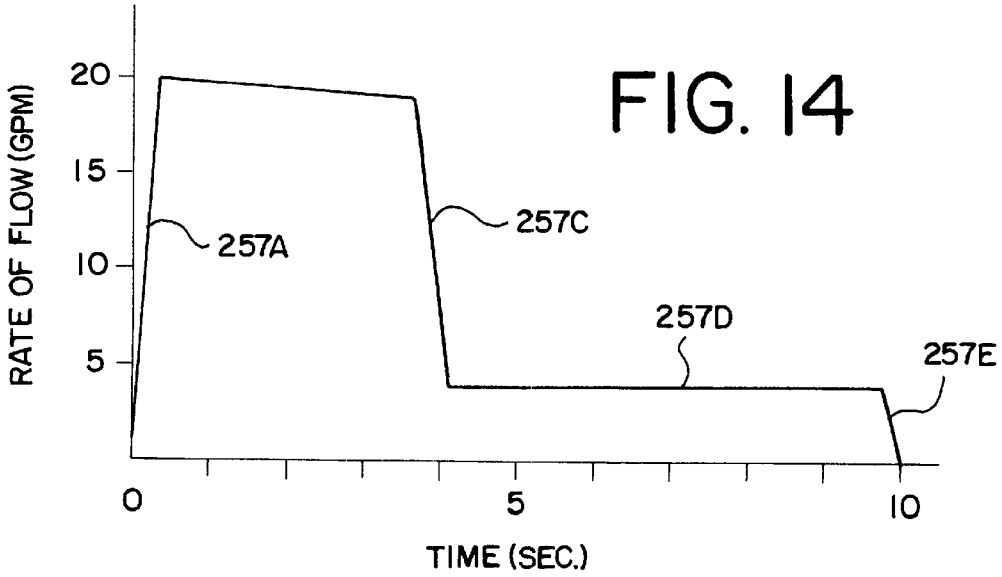
FIG. 14 is a graphical representation of the water delivery profile of the flush controller for a flush cycle of a toilet fixture.

A representation of the flow of water through the flush controller 20 in a typical toilet fixture flush cycle is shown graphically by the flow rate vs. time line 257 in FIG. 14. A ten second flush cycle begins at time zero. Line segment 257A shows a rapid increase in flow from zero to a high flow rate of about twenty GPM in a small fraction of a second as the low and high flow solenoids 58 and 60 are energized to open the low and high flow valve assemblies 54 and 56. The high flow indicated by line segment 257B continues until somewhat less than four seconds into the flush cycle, when the high flow solenoid 60 is deenergized to close the high flow valve assembly 56. During the high flow period, about 1.2 gallons of water flows to the fixture. Line segment 257C represents the transition from high flow to low flow that takes place during the fraction of a second while the high flow valve assembly 56 closes. The low flow for trap reseal, indicated by line segment 257D, continues for about six seconds at a flow rate of about of about four GPM to supply about 0.4 gallons to the fixture. The line segment 257E illustrates the closing of the low flow valve assembly 54 after total flow of about 1.6 gallons. The representation of FIG. 14 is idealized to facilitate understanding of the invention, and in practice the line 257 may not have straight line segments and has rounded rather than sharp comers.

The flush control system 30 uses flow feedback signals from the flow sensor 28. The flow sensor 28 directly measures flow through the low flow valve assembly 54, and provides an accurate measurement of amount and rate of flow over a wide range of pressures and flow rates. When both the low flow and high flow valve assemblies 54 and 56 are open, water flows in parallel paths through these assemblies. Under steady state conditions when both the high and low flow valve assemblies 54 and 56 are open, the flow rates and quantities in the parallel paths are proportional in a fixed ratio determined by the flow restrictions in the two parallel paths. Therefore an accurate determination of flow through the high flow valve assembly is calculated by the flow control system 30 using the measured flow through the low flow rate valve assembly 54. The flow restrictions of the flow paths through the low and high flow valve assemblies 54 and 56, and thus their flow impedances, in a preferred embodiment of the invention are related by a ratio of one to eight. Thus when both valve assemblies 54 and 56 are open, the volume of flow through the high flow valve assembly 56 is larger than the volume of flow through the low flow valve assembly by a factor of eight.

The sensor 152 provides an electrical pulse to the control system 30 for each rotation of the turbine spool 142. In a preferred embodiment of the invention, the turbine spool 142 completes 2,070 revolutions and provides an output signal with 2,070 pulses for each one gallon of flow through the low flow valve assembly 54. When only the low flow valve assembly 54 is open, the flush control system 30 determines the rate and volume of flow by counting these pulses. When both the low and high flow valve assemblies 56 and 54 are open, the flush control system 30 determines the total rate and volume of flow by counting the flow signal pulses to measure flow through the low flow valve assembly 54 and by calculating the flow through the high flow valve assembly 56. This calculation is done using the eight to one flow ratio and using a transition algorithm stored in the memory 33 and implemented by the microprocessor 32 for determining flow through the high flow valve assembly when it is in transition, moving between open and closed positions as the high flow valve assembly 56 opens and closes. The low and high flows are added to calculate the total flow rate and volume. The resulting precise determination of water flow through the flush controller 20 permits accurate control throughout the entire flush cycle. The water flow in each stage of the flush cycle is accurately metered, and the total water flow for the cycle can be limited to a desired maximum. Flow during the high flow rate burst can be maximized while maintaining sufficient subsequent low flow for reliable fixture trap reseal, resulting in improved flushing performance.

In normal operation, the flush control system 30 functions to energize and deenergize the solenoids 58 and 60 to carry out the flush cycle. A normal flushing operation or alternatively an emergency or setup flushing operation can be initiated by the override control 36 illustrated in FIGS. 16–20. An override disk lever 258 is pivotally supported on a stem 260 of an override valve 262. The valve 262 and stem 260 are normally held in an upper position seen in FIGS. 16 and 17 by engagement with the spring seat 94. In this position, the override valve 262 closes an override valve port 264 in the cap 86 communicating with the passage 112.

Figure 20:
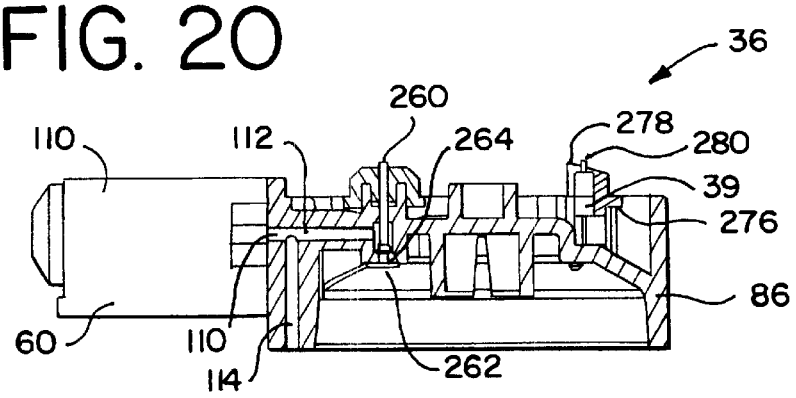
FIG. 20 is an enlarged sectional view of the high flow valve cap and components of the override control of the flush controller.

The override button 38 is received in an opening in an escutcheon 266 threaded onto a retainer hub 268. The retainer hub 268 extends through an opening 269 (FIG. 3) in the top wall of the front cover 42. A resilient seal cup 270 (FIG. 19) is sandwiched between the button 38 and the hub 268 for sealing the interior of the cover 42 and for biasing the button 38 to its upper, normal, standby position seen in FIG. 16. A drive screw 272 (FIG. 19) positions and loosely holds the lever 258 to a stem portion 274 of the button 38. As seen in FIG. 20, the switch 39 is nested in a holder 276 having opposed pivot lugs 278 flanking an actuator nose 280 of the switch 39.

The button 38 can be pressed downward to two different positions with either a light force (FIG. 17) or a substantially stronger force (FIG. 18) to initiate either a normal or an emergency flush. When the user presses the button 38 to a first position seen in FIG. 17, the stem portion 274 of the button 38 presses the lever 258 downward, and the lever pivots about a pivot point defined by the top of the stem 260. The override switch 39 senses this movement of the lever 258 as the lever 258 depresses the nose 280 of the switch 39 and causes the normally closed switch (FIG. 15) to open. The spring force applied by the spring 92 and spring seat 94 against the valve 262 and the stem 260 is large enough to cause the switch nose 280 to be depressed before the stem 260 is moved downwardly. The switch 39 thus functions as a sensing device to detect movement of the button 38 from the normal, standby position of FIG. 16 to the first override position of FIG. 17. Operation of the switch 39 provides a flush initiation signal to the control system 30 through the connector 210 and contacts 204. In response to this signal, the control system 30 carries out a normal flush cycle as represented in FIG. 14. The ability to perform a flush operation during use of a sanitary fixture is a desirable feature. In addition, the ability to carry out a flush operation during installation of the flush controller 20 and adjustment of the control stop 24 is also desirable.

Figure 17:
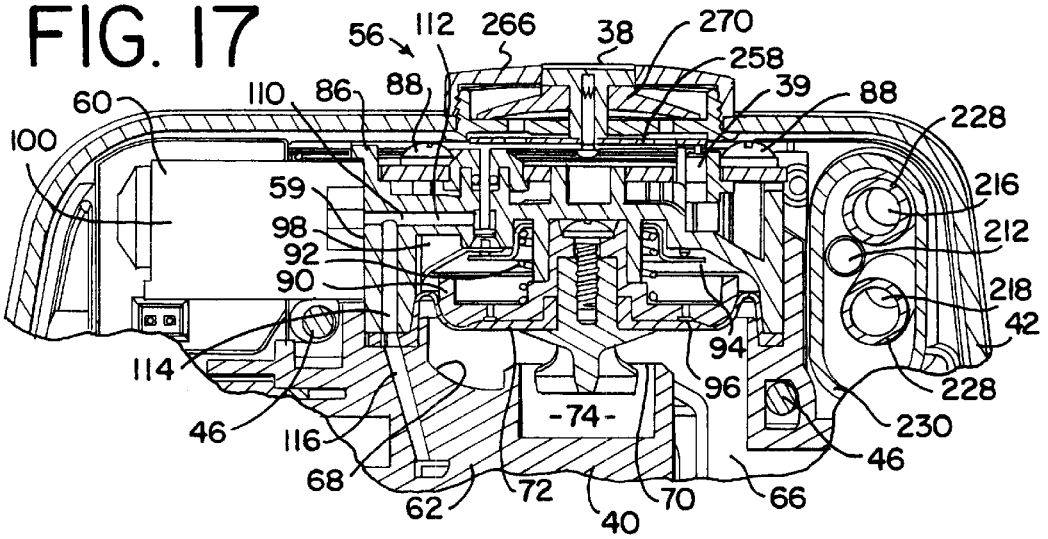
FIG. 17 is a view like FIG. 16 showing the override control operated to a first override position and showing the high flow valve assembly open in a normal flush operation.
Figure 18:
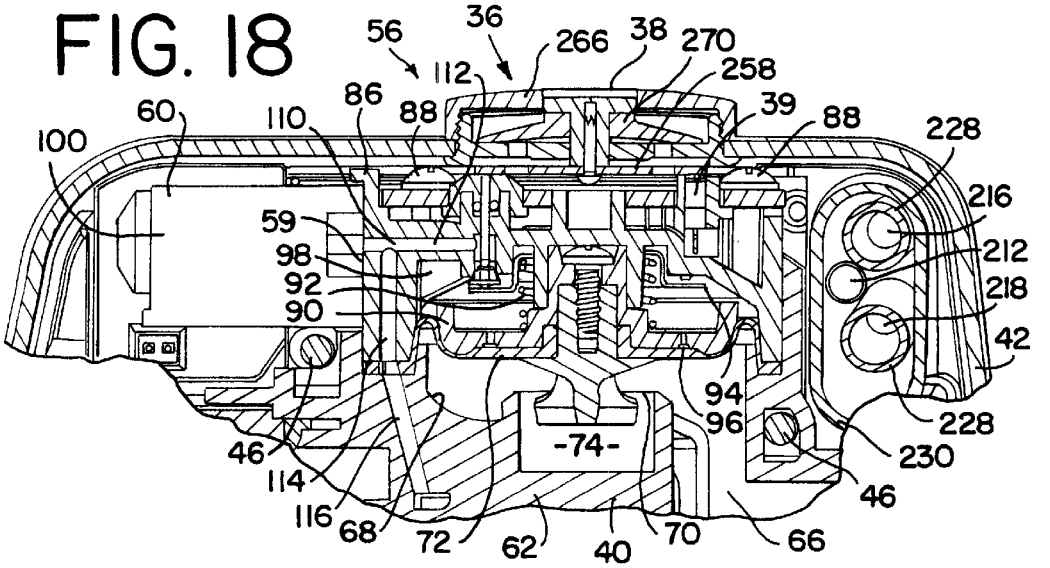
FIG. 18 is a view like FIGS. 16 and 17 showing the override control operated to a second override position and showing the high flow valve assembly open in an emergency or setup flush operation.
Figure 19:
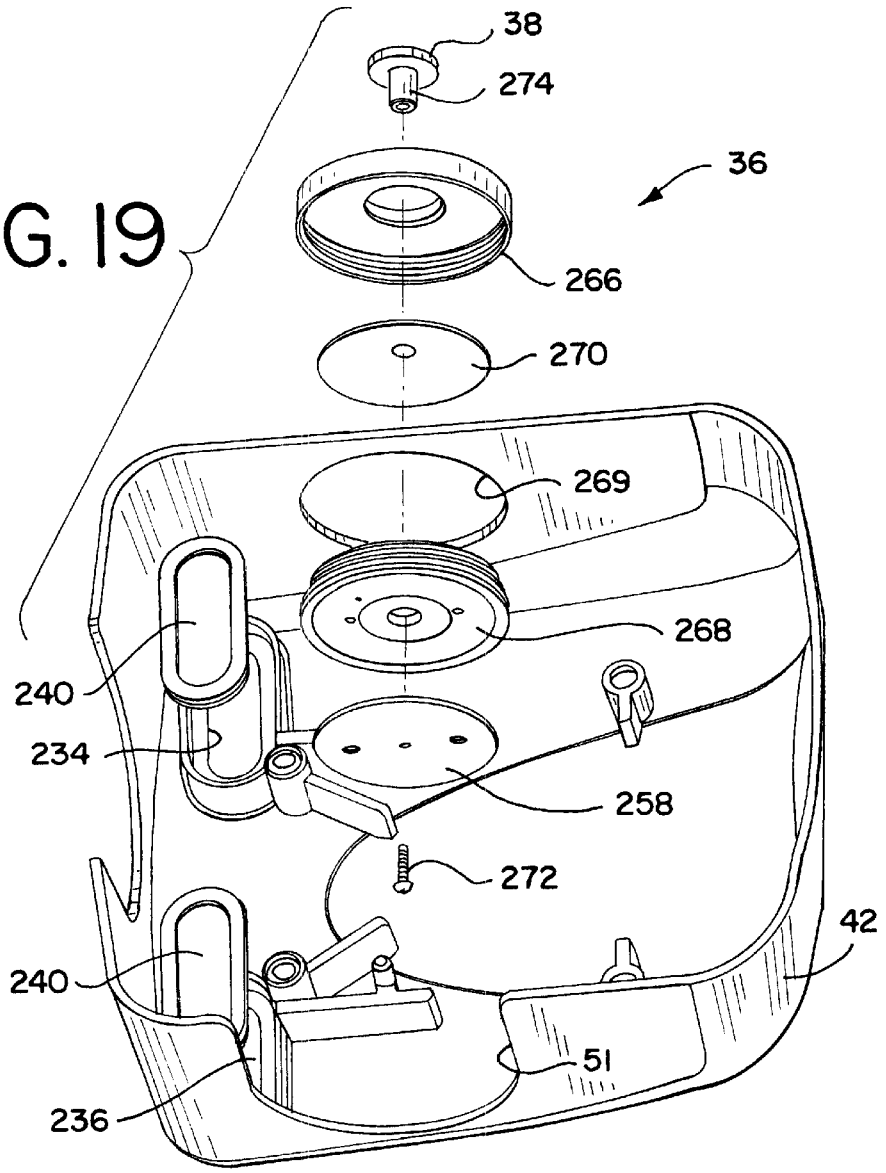
FIG. 19 is an exploded isometric view of the front cover and components of the override control of the flush controller.

If the button 38 is pressed further downward beyond the position of FIG. 17 toward the position of FIG. 18, the lever 258 contacts the lugs 278 of the switch holder 276. The contact with the lugs 278 protects the switch 39 from excessive force and over stroking. If the force applied to the lever 258 is increased sufficiently to overcome the force of the spring 92 and deflect the spring seat 94, the lever 258 pivots about the lugs 278 and forces the stem 260 downward. As a result, the valve port 264 opens to permit water to flow from the control chamber 98 and through passages 112, 114 and 116 to the outlet port 26. The valve 262 and port 264 act as an override pilot valve in parallel flow relation to the high flow solenoid pilot valve 60. When the override pilot 262 opens, the reduction in control chamber pressure causes the high flow valve assembly 56 to open, and water flows at a high rate between the inlet port 22 and the outlet port 26. Because this operation does not use the flush controller 30 or the high flow solenoid pilot valve 60, electrical power is not needed. An emergency flush can be carried out in the event of battery discharge or circuit malfunction. In addition, an installer of the flush controller 20 can manually maintain the high flow valve assembly 56 continuously in an open condition for a sufficient period of time to adjust the control stop 24 to avoid splashing in the sanitary fixture.

Figure 23:
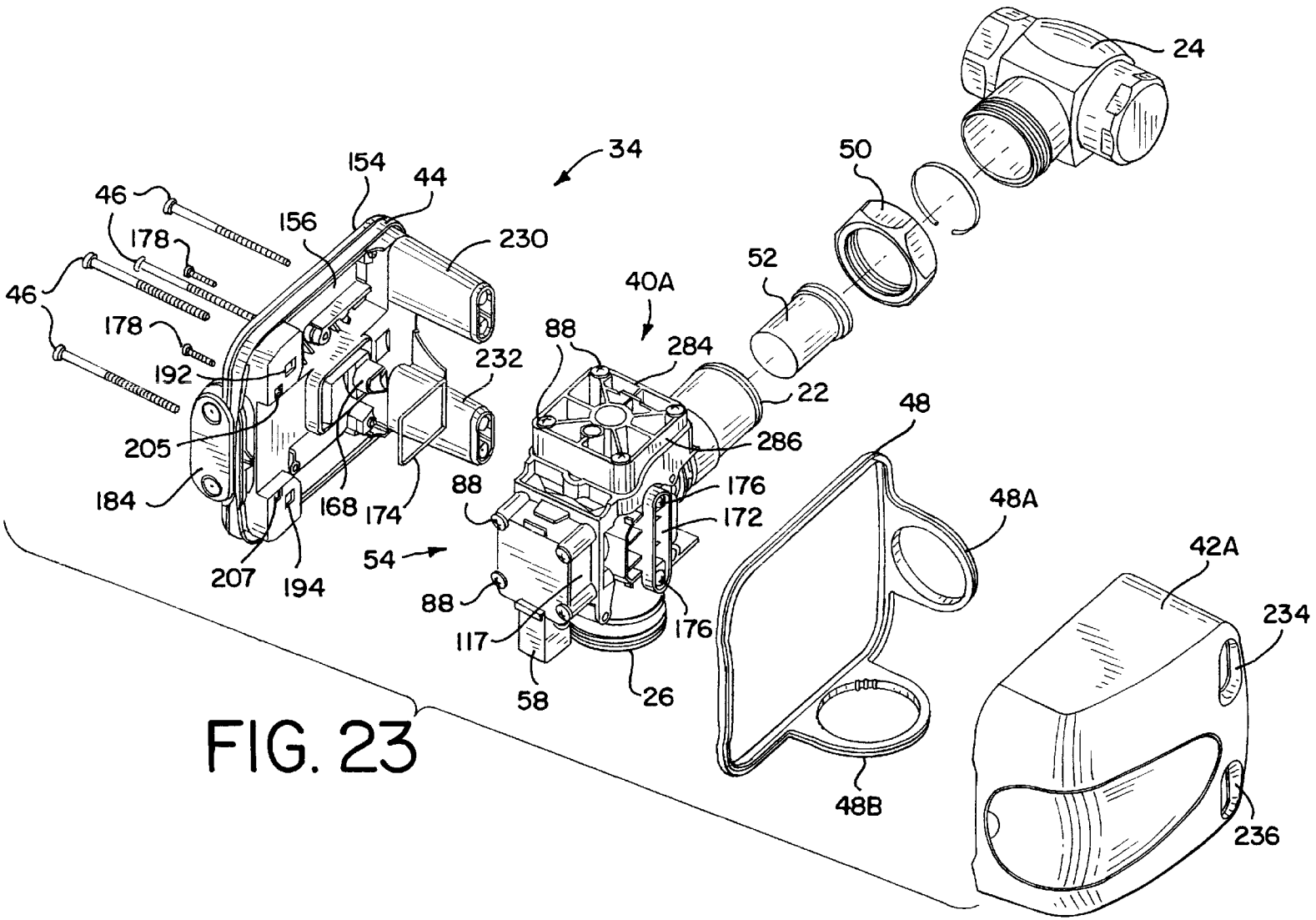
FIG. 23 is an exploded isometric view, similar to FIG. 5, illustrating the flush controller configured to flush a urinal rather than a toilet.

As described above and as illustrated in FIGS. 1–7 and 14–20, the flush controller 20 is configured to supply flushing water to a siphon flush toilet requiring an initial burst of water at a high flow rate for flushing the fixture followed by a low flow rate water delivery for resealing the fixture trap. The flush controller 20 can alternatively be configured to supply flushing water to a urinal requiring a measured flow of water at a constant low flow rate. In this configuration, as seen in FIGS. 23 and 24, the high flow valve assembly 56 and the override control 36 are omitted from the flush controller 20. Many other components are common to both configurations.

Referring to the urinal configuration seen in FIGS. 23 and 24, a front cover 42A is similar to the front cover 42 of the toilet version but lacks the top opening for the override button 38 and associated elements. A valve body assembly 40A is similar to the valve body assembly 40 of the toilet version but lacks the components of the high flow valve assembly 56, including the high flow valve cap 86 and the high flow solenoid 60.

In place of the high flow valve cap 86 and the high flow valve member 72, in the urinal version of FIG. 23, the high flow valve cavity 68 at the top of the valve body 62 is closed and sealed by a plug assembly 284 attached to the body 62 by fasteners 88. As seen in FIG. 24, the plug assembly includes a body 286 with an exterior shape similar in some respects to the high flow valve cap 86 and a sealing diaphragm 288 similar in some respects to the high flow valve 72. When the plug assembly is installed and held with the fasteners 88, the imperforate diaphragm 288 seats against the high flow valve seat 70 and seals the cavity 68.

Figure 10:
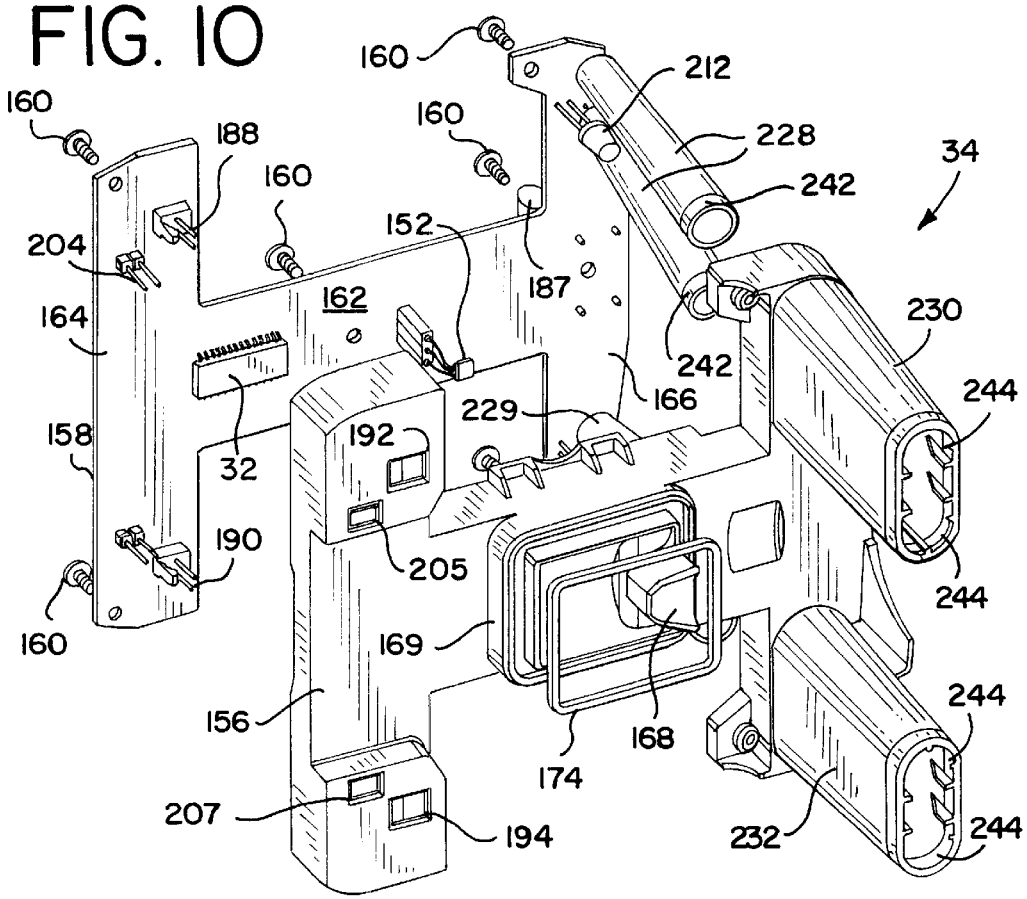
FIG. 10 is an exploded front isometric view of the electronics enclosure of the back plate assembly.

When the components of the urinal version of FIG. 23 are assembled, the cable 200 and connector 202 (FIGS. 8 and 15) are connected through the window 194 to the terminal pins 190 on the circuit board 158 (FIGS. 10 and 15). This connection permits the flush control circuit to energize the low pressure solenoid 58 in order to open the low pressure valve assembly 54 and provide a low flow rate supply of water to the outlet port 26. This flow is measured by the flow sensing assembly 28. Because the high flow valve solenoid 60 is not present in the urinal configuration, there are no connections made to the terminal pins 188 through the window 192. Because the override switch 39 is not present in the urinal configuration, there are no connections to the terminal pins 204 or the terminal pins 206 through the window 205 or the window 207. Both the toilet and the urinal versions use the same circuit board 158 with the same components. The terminal pin connection pattern for a urinal differs from the terminal pin configuration for a toilet. This difference can be used by the flush control 30 at the time of installation or setup of the flush controller to detect whether the controller is configured for a toilet or for a urinal, and to tailor the flush control procedure accordingly.

Figure 25:
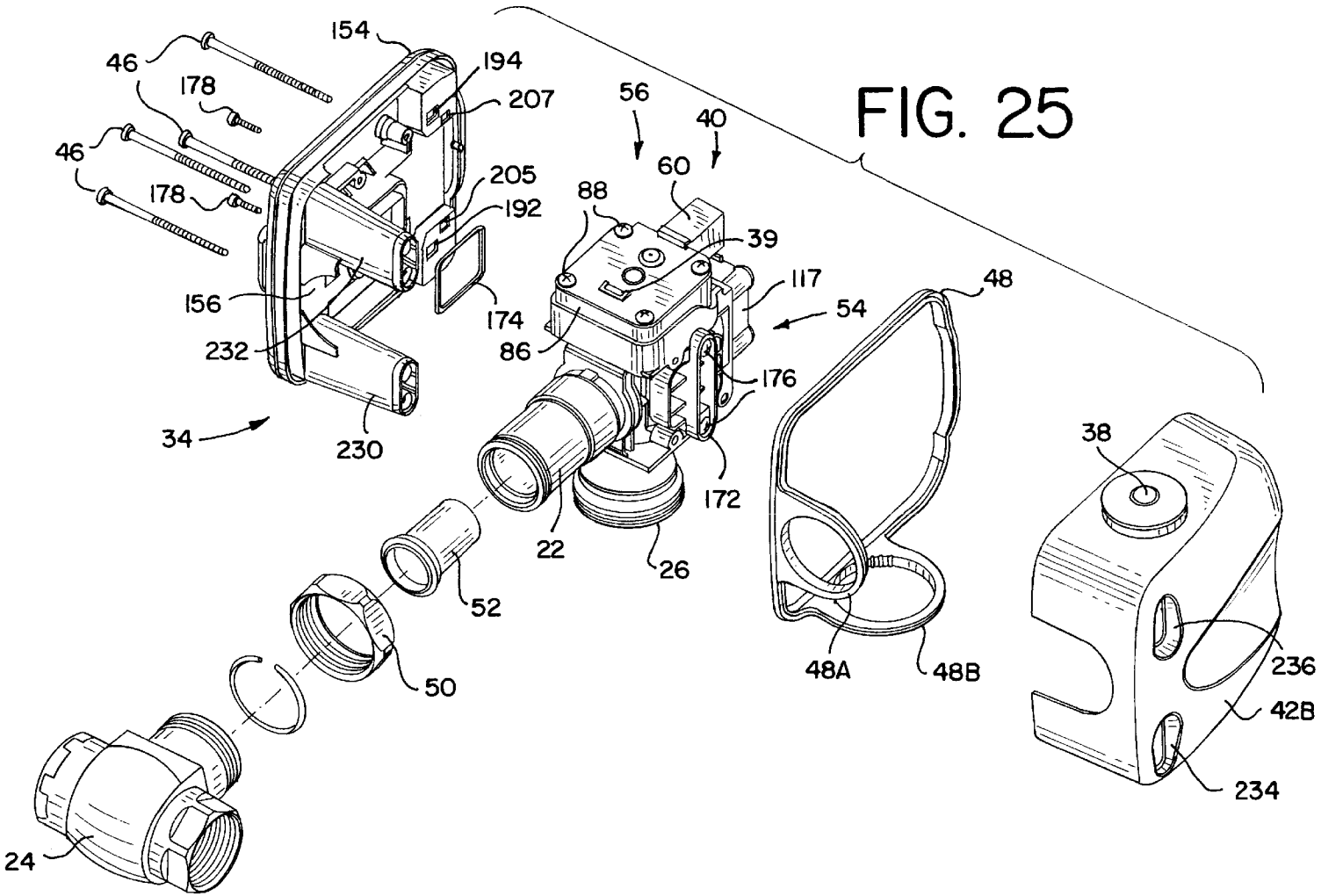
FIG. 25 is an exploded isometric view, similar to FIG. 5, illustrating the flush controller configured for a water supply connection on the left side rather than the right side of the flush controller.

As illustrated in FIGS. 1–7 and 14–20, the flush controller 20 is configured with the inlet port 22 at the right, for connection through the control stop 24 to a water supply conduit located at the right side of the flush controller 20. As illustrated in FIG. 25, and comparing FIGS. 5 and 25, the flush controller can be configured for a left side water supply. The change in configuration is accomplished by changing the orientation of the valve body assembly 40 and of the back plate assembly 44 of the flush controller.

Figure 5:
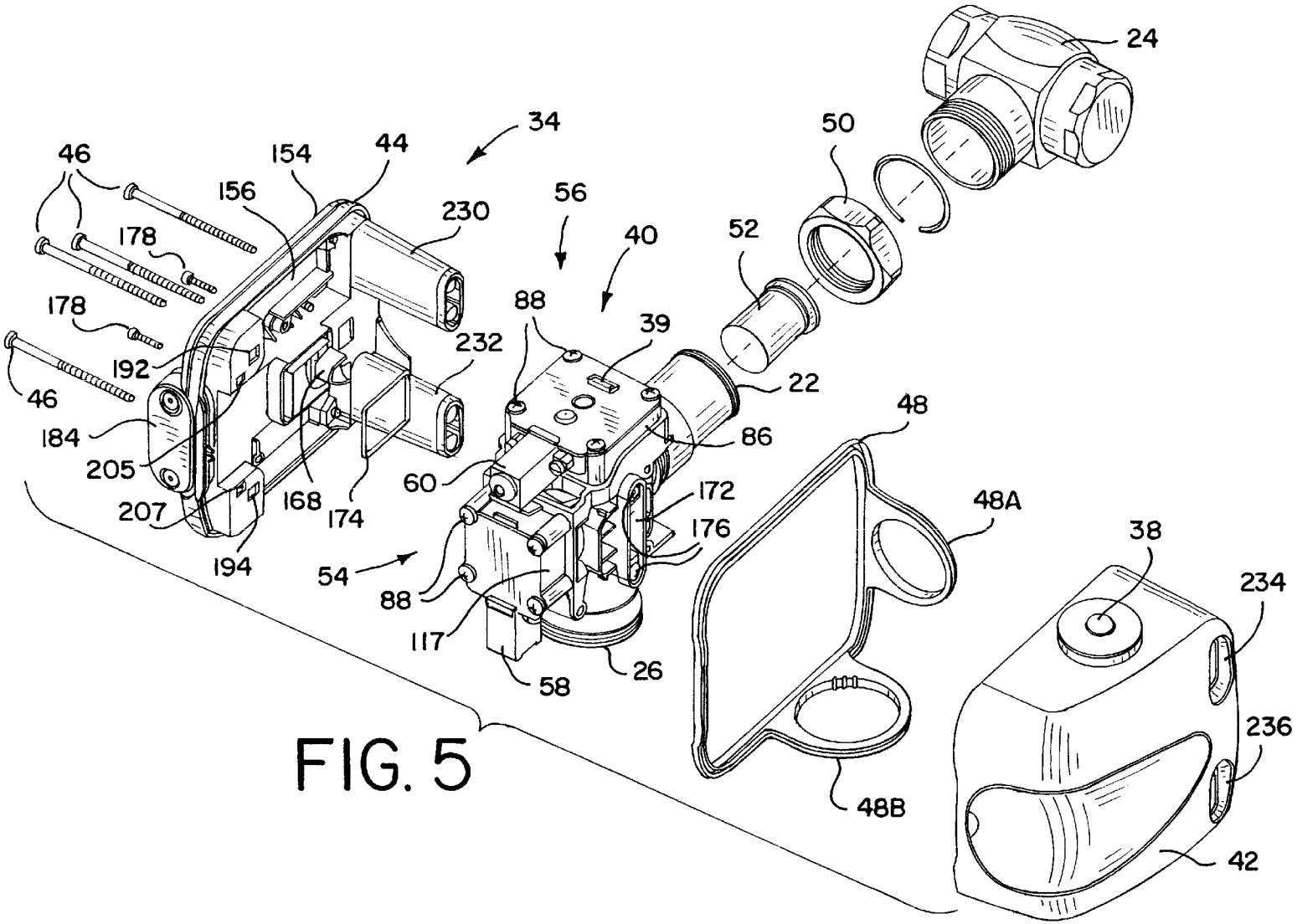
FIG. 5 is an exploded isometric view of the flush controller showing the valve body assembly separated from the back plate assembly, the gasket and cover subassembly and the control stop.
Figure 6:
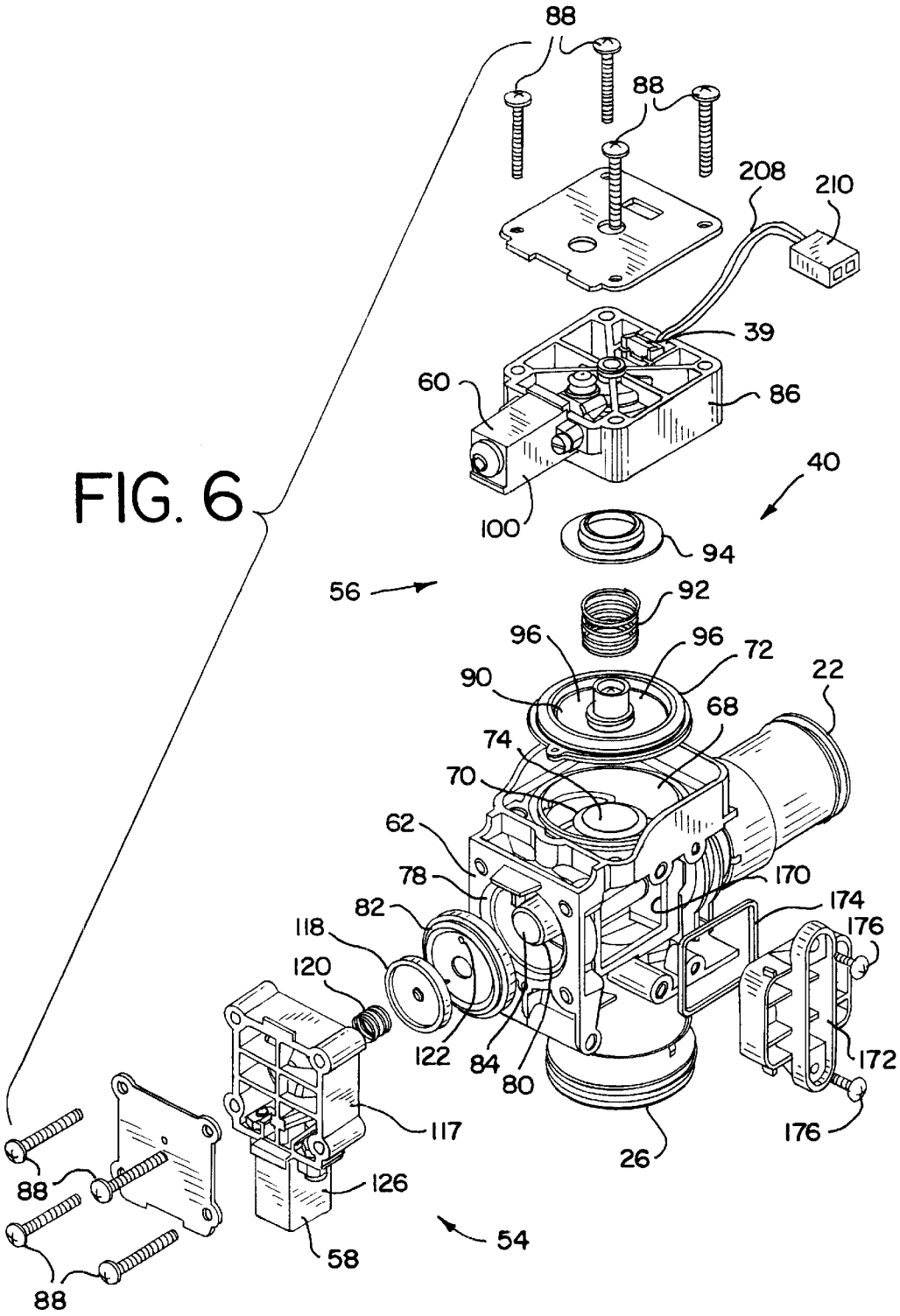
FIG. 6 is an exploded isometric view of the valve body assembly of the flush controller.

For a left side water entry, the valve body assembly 40 is rotated from the orientation of FIG. 5 one-hundred-eighty degrees around the vertical Z axis of FIG. 21. This places the inlet port 22 at the left side of the valve body assembly 40. The bulkhead member 172 is attached by fasteners 176 to close the window 170 that in this configuration is at the front of the valve body 62. The high flow valve assembly 56 is at the top of the valve body 62 with the override switch 39 toward the left side of the assembly 40, rather than toward the right side as seen in FIG. 5. The high flow solenoid pilot valve 60 is located at the right side of the assembly 40, rather than the left side as in FIG. 5. The low flow valve assembly 54 and the low flow solenoid pilot valve 58 are located at the right side of the body 62, opposite the inlet port 22. The left side entry configuration uses a front cover 42B with the outlet port opening 51 and the override hub opening 269 reversed.

For the left side water entry configuration of FIG. 25, the back plate assembly 44, including the electronics enclosure 156 and the circuit board 158, is rotated from the orientation of FIG. 5 one-hundred-eighty degrees around the horizontal Y axis of FIG. 21. Upon assembly, the centrally located sensor well 168 containing the Hall effect sensor 152 is received in the window 170 at the rear of the valve body 62 and is sealed by gasket 174. The user detection system 34 is located at the left side of the flush controller 20. The tower 232 and detectors 220 and 222 are located above the tower 230 and emitters 216 and 218. The array of intersection points 251–254 of the user detection system 34 (FIGS. 21 and 22) is inverted, but this does not change the function of the user detection system 34. The terminal pin windows 194 and 207 are at the top and right of the electronics enclosure 156, rather than at the bottom left as seen in FIG. 5. The terminal pin windows 192 and 205 are at the bottom right of the electronics enclosure 156 rather than at the top left as seen in FIG. 5.

When the components of the left side water supply entry configuration of FIG. 25 are assembled, the cable 208 and the connector 210 for the override switch 39 are connected through the window 207 to the terminal pins 206 (FIG. 10), rather than through the window 205 to the terminal pins 204 as in FIG. 5. The cable 196 and connector 198 for the high flow valve solenoid 60 are connected through the window 194 to the terminal pins 190, rather than through the window 192 to the terminal pins 188 as in FIG. 5. The cable 200 and connector 202 for the low flow solenoid valve 58 are connected through the window 192 to the terminal pins 188, rather than through the window through the window 194 to the terminal pins 190 as in FIG. 5. Thus, the terminal pin connection pattern for left side water entry differs from the terminal pin configuration for right side water entry. This difference can be used by the flush control system 30 at the time of installation or setup of the flush controller 20 to detect whether the controller is configured for right or left water supply entry, and to tailor the flush control procedure accordingly.

The flush controller can also be configured for a urinal, as in FIG. 23, but with left side water supply, as in FIG. 25. Any of the four different configurations, toilet with left water supply, toilet with right water supply, urinal with left water supply, and urinal with right water supply, is easily assembled at the time of manufacture. For either toilet configuration, the overflow switch 39 and the high flow valve assembly 56 are used. For either urinal configuration, the overflow switch 39 and the high flow valve assembly 56 are omitted. For right side water supply of either a toilet or a urinal, the valve body assembly 40 or 40A and the back plate assembly 44 are oriented as seen in FIGS. 5 and 23. For left side water supply of either a toilet or a urinal, the valve body assembly 40 or 40A and the back plate assembly 44 are oriented as seen in FIG. 25. The ability to use and simply reorient common parts in all configurations is an important advantage.

While the present invention has been described with reference to the details of the embodiment of the invention shown in the drawing, these details are not intended to limit the scope of the invention as claimed in the appended claims.

What is claimed is:

1. A flush controller for siphon flushing and resealing the trap of a sanitary fixture comprising:

a housing having an inlet for connection to a water supply and an outlet for connection to the sanitary fixture;

a control system including a microprocessor mounted within said housing;

a high flow path between said inlet and said outlet, and a high flow valve in said high flow path;

a first electrical valve operator for opening and closing said high flow valve;

a low flow path between said inlet and said outlet, and a low flow valve in said low flow path;

a second electrical valve operator for opening and closing said low flow valve;

said low and high flow paths having flow restrictions with a proportional relationship;

a flow sensor in said low flow path for measuring flow in said low flow path and providing an output signal;

means for providing an initiation signal to said control system;

said control system including means for operating said first and second valve operators for opening said high flow and low flow valves in response to said initiation signal in order to provide a siphon flush flow through said output port;

said control system including means for determining the volume of said siphon flush flow using said proportional relationship and said output signal, and for operating said first valve operator to close said high flow valve after a first predetermined siphon flow volume to provide a continuing trap reseal flow; and said control system including means for using said output signal to determine the volume of said trap reseal flow and for operating said second valve operator to close said low flow valve after a second predetermined trap reseal flow volume.

2. A flush controller as claimed in claim 1, said first and second valve operators including solenoids.

3. A flush controller as claimed in claim 2, said first and second valve operators further including pilot valves opened and closed by said solenoids.

4. A flush controller as claimed in claim 1, said initiation signal providing means comprising a user sensing system for sensing the presence of a user of the sanitary fixture.

5. A flush controller as claimed in claim 1, said initiation signal providing means comprising a manually operated member.

6. A flush controller as claimed in claim 1, said flow sensor comprising a turbine in said low flow path.

7. A flush controller as claimed in claim 6, said flow sensor further including a magnet carried by said turbine and a detector adjacent said turbine for detecting each passage of said magnet, said output signal including a string of said pulses.

8. A flush controller as claimed in claim 7, said control system including means for converting said pulses to flow volume.

9. A method of controlling a siphon flush flow and a trap reseal flow to a sanitary fixture, said method comprising:

opening both a high flow valve and a low flow valve disposed in parallel high and low flow paths between a water supply and the sanitary fixture;

sensing flow through the low flow path;

determining the sum of the flows through the low and high flow paths using the sensed flow through the low flow path and using a proportional flow restriction relationship of the high and low flow paths; and closing the high flow valve when the sum of the flows through the low and high flow paths reach a volume equal to a desired siphon flush flow volume.

10. The method of claim 9, further comprising maintaining the low flow valve open after said high flow valve closing step to provide a continuing trap reseal flow;

measuring the flow through the low flow path after said high flow valve closing step; and closing the low flow valve when the measured flow reaches a volume equal to a desired trap reseal flow volume.

11. The method of claim 9, said sensing step comprising detecting rotations of a magnet carried by a turbine located in the low flow path.

12. The method of claim 10, said opening and closing steps comprising operating solenoids associated with said high and low flow valves.

13. A flush controller for a sanitary fixture comprising:

a housing having an inlet for connection to a water supply and an outlet for connection to the sanitary fixture;

a valve for controlling flow from said inlet to said outlet;

a control system operative in response to an initiation signal for opening said valve to initiate a flushing operation;

a user sensing system for detecting the presence of a user in a single detection zone adjacent to the sanitary fixture;

said user sensing system including a number x plurality of radiation emitters and a number y plurality of radiation detectors;

means connected to said detectors and responsive to radiation reflected by a user from said emitters to said detectors for providing said initiation signal;

said emitters being aimed along discrete and spaced apart emission lines extending away from said housing into said zone;

and detectors being aimed along discrete and spaced apart detection lines extending away from said housing into said zone; and each of said emission lines intersecting each of said detection lines at a number of spaced apart intersection points in said zone, the number of said detection points being equal to the product of x times y.

14. The flush controller of claim 13, said housing having a front including radiation windows and a rear, said emitters and detectors being mounted adjacent said rear of said housing, and a plurality of sight tubes extending from said emitters and detectors to said windows to aim said emitters and detectors along said emission and detection lines.

15. The flush control of claim 14, further comprising a circuit board adjacent said rear of said housing, said emitters and detectors being mounted at mounting points on said circuit board, said sight tubes being pivotally mounted adjacent said windows.

16. The flush control of claim 13, said radiation emitters being infra red LED's and said radiation detectors being infra red detectors.

17. The flush control of claim 13, there being two said emitters and two said detectors.

18. The flush control of claim 13, said emission lines and said detection lines all lying in a sensitive region having a generally flat, planar shape.

19. The flush control of claim 18, said housing having a principal front-to-back axis, said sensitive region being skewed with respect to said axis.

20. A flush controller for a sanitary fixture comprising:

a housing having an inlet for connection to a water supply and an outlet for connection to the sanitary fixture;

a valve for controlling flow from said inlet to said outlet;

a user sensing system for detecting the presence of a user of the sanitary fixture and for providing a flush initiation signal;

a control system operative in response to said initiation signal for opening said valve to initiate a flushing operation;

an override control system including a manually operable member, said manually operable member being mounted for movement from a normal, standby position to first and second different override positions;

a sensing device in said housing for detecting movement of said manually operable member to said first override position and for providing an override flush signal;

said control system being operative in response to said override flush signal for opening said valve to initiate a flushing operation; and said manually operable member being connected to said valve independently of said control system for opening said valve in response to movement of said manually operable member to said second override position.

21. A flush controller as claimed in claim 20 wherein said manually operable member is a push button.

22. A flush controller as claimed in claim 20 wherein said sensing device is a switch.

23. A flush controller as claimed in claim 20 wherein said control system is electrically powered.

24. A flush controller as claimed in claim 20, further comprising a flush control pilot for opening said valve and a solenoid for operating said pilot, said control system being connected to said solenoid for energizing said solenoid to initiate said flushing operation.

25. A flush controller as claimed in claim 24, further comprising an override lever coupled to said manually operable member, said lever being mounted to pivot in a first direction in response to movement of said manually operable member to said first override position and to pivot in a second direction in response to movement of said manually operable member to said second override position.

26. A flush controller as claimed in claim 25, said sensing device comprising a switch mounted in the path of said lever when said lever pivots in said first direction.

27. A flush controller as claimed in claim 26, further comprising an override pilot in parallel flow relation with said flush control pilot, said override pilot including an operating element mounted in the path of said lever when said lever pivots in said second direction.

28. A method for adapting a flush controller for toilet and urinal applications and for right or left water supply installations;

the flush controller having a valve assembly including a valve body with a vertically extending outlet port and a horizontally extending inlet port, a low flow valve located at a first region of the valve assembly, a high flow valve receiving location at a second region of the valve assembly, and a override switch receiving location at a third region of the valve assembly; the low flow valve having a low flow valve electrical connector, the flush controller optionally having a high flow valve with a high flow valve electrical connector at the high flow valve receiving location and optionally having an override switch with a switch connector at the override switch receiving location;

the flush controller further having an electrical circuit board including a plurality of electrical terminals arrayed at spaced locations over the surface of the circuit board;

said method comprising:

omitting the high flow valve for urinal applications and mounting the high flow valve at the high flow valve receiving location for toilet applications;

rotating the valve assembly around a vertical axis to point the inlet port either to the right or the left;

connecting the low flow valve electrical connector to circuit board terminals adjacent the first region of the valve assembly; and if the high flow valve is present, then connecting the high flow valve electrical connector to circuit board terminals adjacent the second region of the valve assembly.

29. A method as claimed in claim 28, further comprising omitting the override switch for urinal applications and mounting the override switch at the override switch receiving location for toilet applications.

30. A method as claimed in claim 29 further comprising, if the override switch is present, then connecting the switch connector to circuit board terminals adjacent the third region of the valve assembly.

31. A method as claimed in claim 28, further comprising orienting the circuit board in one of two positions adjacent the valve assembly depending upon whether the inlet port is pointed to the right or the left.

32. A method as claimed in claim 31, said orienting step comprising rotating the circuit board around a horizontal axis.

* * * * *